US007591459B2

(12) United States Patent
Matsumoto et al.

(10) Patent No.: US 7,591,459 B2
(45) Date of Patent: Sep. 22, 2009

(54) SHEET FEEDING APPARATUS AND IMAGE FORMING APPARATUS

(75) Inventors: Yuzo Matsumoto, Abiko (JP); Tetsuro Fukusaka, Abiko (JP); Taro Ikeda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/693,179

(22) Filed: Mar. 29, 2007

(65) Prior Publication Data

US 2007/0228639 A1 Oct. 4, 2007

(30) Foreign Application Priority Data

Apr. 3, 2006 (JP) ..... 2006-101824
Mar. 23, 2007 (JP) ..... 2007-076661

(51) Int. Cl.
*B65H 3/14* (2006.01)

(52) U.S. Cl. ..... 271/97; 271/98

(58) Field of Classification Search ..... 271/97, 271/98, 105, 162, 258.01, 265.02, 30.1
See application file for complete search history.

(56) References Cited

U.S. PATENT DOCUMENTS 5,110,110 A * 5/1992 Wirz et al. ..... 271/98
5,645,274 A 7/1997 Ubayashi et al. ..... 271/94
6,131,898 A 10/2000 Hiroi et al. ..... 271/10.03
6,186,492 B1 * 2/2001 Dechau et al. ..... 271/30.1
6,279,896 B1 * 8/2001 Linder et al. ..... 271/98
6,354,585 B1 * 3/2002 Takahashi ..... 271/97
2005/0006068 A1 1/2005 Desai et al. ..... 165/140
2005/0040584 A1 * 2/2005 Isemura ..... 271/97
2006/0012107 A1 * 1/2006 Ueda et al. ..... 271/98
2007/0069446 A1 * 3/2007 Lamendola et al. ..... 271/98

FOREIGN PATENT DOCUMENTS

JP 7-89625 4/1995
JP 7-196187 8/1995

* cited by examiner

*Primary Examiner*—Patrick H Mackey
*Assistant Examiner*—Luis Gonzalez
(74) *Attorney, Agent, or Firm*—Fitzpatrick, Cella, Harper & Scinto

(57) ABSTRACT

An image forming apparatus has a sheet feeding apparatus which separates and feed a sheet one by one using a loosening fan which blows air from an air blowing portion for loosening the sheet on a tray. The rotating speed of the sheet loosening fan is adjusted while the sheet supported by the tray is not located in front of a position where the air is blown from the air blowing portion.

18 Claims, 32 Drawing Sheets

FIG. 8

| PAPER BASIS WEIGHT | COEFFICIENT FOR ADJUSTMENT VALUE |
|---|---|
| THIN PAPER | 0.25 |
| PLAIN PAPER | 0.5 |
| THICK PAPER | 0.75 |
| THICKEST PAPER | 1.0 |

FIG. 15

(1) PWM 100% IN THE CASE OF ONE FAN

| | (Hz) |
|---|---|
| ROTATING SPEED | 600 |

→ 1000Pa (2) AIR QUANTITY ADJUSTING TARGET VALUE IN THE CASE OF ONE FAN

| | (Hz) |
|---|---|
| TARGET VALUE | 500 |
| TARGET UPPER-LIMIT VALUE | 502 |
| TARGET LOWER-LIMIT VALUE | 498 |

→ REALIZE 840 Pa

SHEET FEEDING APPARATUS AND IMAGE FORMING APPARATUS

BACKGROUND OF THE INVENTION

1. Field of the Invention

The present invention relates to an image forming apparatus equipped with a sheet feeding apparatus that feeds a sheet.

2. Description of the Related Art

Conventionally the image forming apparatus such as a copying machine and a printer is equipped with the sheet feeding apparatus. The sheet feeding apparatus feeds the sheet cut into a predetermined size to a transfer position one by one in order to transfer a toner image, formed on a photosensitive member, onto the sheet at the transfer position.

For example, Japanese Patent Application Laid-Open No. 7-196187 discloses a sheet feeding apparatus having a configuration in which air is blown to the sheet from one end side in a conveyance direction of the sheets loaded in an accommodation box using a separating fan and the floating sheet is adsorbed to and conveyed by a conveyance belt.

However, a floatation amount depends on a material (thickness or weight) of the sheet. Therefore, there is proposed a configuration in which lifting and lowering of the tray on which the sheets are loaded are controlled such that the sheet floatation by the air blow is positioned within a predetermined range. For example, in a configuration disclosed in USP 200506068A1, position detecting unit determines whether or not the sheet floatation position is located within a predetermined range, and the tray is lifted and lowered such that the floating sheet is located within the predetermined range when the sheet floatation position is located out of the predetermined range.

There is also proposed a configuration in which a rotating speed of the separating fan is controlled such that the sheet becomes the optimum floatation amount irrespective of the material. When the sheet is thin, or when sheet is made of a light material, the control is performed such that the rotating speed of the separating fan is decreased. When the sheet is thick, or when sheet is made of a heavy material, the control is performed such that the rotating speed of the separating fan is increased. Specifically, in a configuration disclosed in Japanese Patent Application Laid Open No. 7-89625, a distance measuring sensor measures a distance from a belt surface of the conveyance belt to the floating sheet, and the air blowing quantity is controlled based on the measured distance by controlling the rotating speed of the separating fan.

There is also proposed a configuration in which the material (thickness and weight) of the sheet on the tray is inputted from an operation portion of the image forming apparatus and the air blowing quantity is uniquely determined according to the inputted material of the sheet.

In the technique disclosed in USP 200506068A1, even if the materials (thicknesses and weights) of the sheets differ from one another, the sheet is positioned within a predetermined range by the lifting and lowering of the tray. However, it cannot be determined whether or not the sheet positioned within the predetermined range becomes an optimum dealing state. As disclosed in Japanese Patent Application Laid-Open No. 7-89625, in order to obtain the optimum dealing state irrespective of the material of the sheet, the rotating speed of the separating fan is changed in each time the material (thickness and weight) of the sheet loaded on the tray is changed. However, even if the rotating speed of the separating fan is set in each sheet material to obtain the proper air blowing quantity, sometimes the proper rotating speed is not stably obtained due to a fluctuation of the fan itself, aged deterioration of fan characteristics, and voltage drop caused by bundle conductors. In this case, for example, when the sheet is thin, or when sheet is made of the light material, the rotating speed of the separating fan is faster than the target value, the sheet dealing state is not stabilized, which possibly results in a trouble such as sheet jam, skew feeding, position shift, a flaw, folded sheet, and dirt. When the sheet is thick, or when sheet is made of the heavy material, the rotating speed of the separating fan is slower than the target value, the proper air does not flow between the sheets, which possibly results in a trouble such as conveyance of overlapped sheets.

In the configuration in which the sheet material (thickness and weight) is inputted from the operation portion of the image forming apparatus, sometimes sheet material (thickness and weight) which is inputted from the operation portion differs from the material of the sheet which is actually loaded on the tray. In such cases, the rotating speed of the separating fan becomes improper value, which possibly results in the trouble such as the conveyance of overlapped sheets, the skew feeding, the position shift, the flaw, the folded sheet, and the dirt.

SUMMARY OF THE INVENTION

In view of the foregoing, an object of the invention is to provide an image forming apparatus, in which the rotating speed of the fan can be set so as to become the optimum air quantity irrespective of the fluctuation of the fan itself, the aged deterioration of the fan characteristics, and the like and the fan can be stabilized at an optimum rotating speed.

An aspect according to the invention provides an image forming apparatus that has a sheet feeding apparatus which separates and feeds a sheet one by one, the image forming apparatus comprising: a tray which supports a plurality of sheets; an air blowing portion which loosens the sheet by blowing air to an end portion of the sheet supported by the tray; and wherein an amount of blowing air from the air blowing portion is adjusted while the sheet supported by the tray moves away from a position at where the sheets are loosened by the air blowing portion.

BRIEF DESCRIPTION OF THE DRAWINGS

FIG. 8 illustrates a coefficient for an adjustment value with respect to the sheet condition;

FIG. 15 illustrates a range of a target value when the fan rotating speed is adjusted;

DESCRIPTION OF THE PREFERRED EMBODIMENTS

Exemplary embodiments of the invention will be described in detail with reference to the drawings. However, in the following embodiments, dimensions, materials, and shapes of components and a relative arrangement of the components should appropriately be changed depending on a configuration of an apparatus to which the invention is applied and various conditions. Accordingly, unless otherwise specifically described, the scope of the invention is not limited to the embodiments.

(Image Forming Apparatus)

Figure 1:
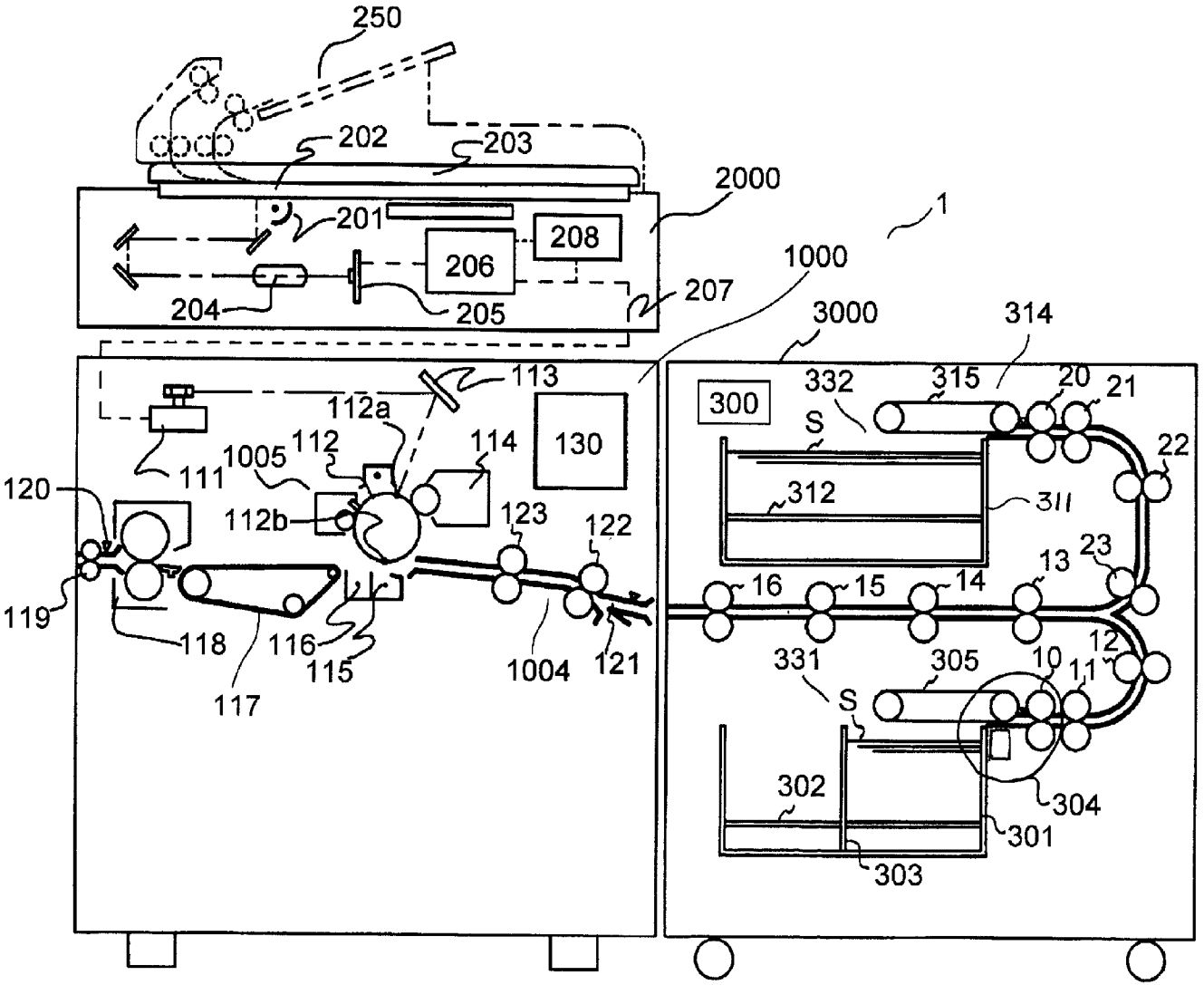
FIG. 1 is a sectional view illustrating a schematic configuration in which a sheet feeding apparatus according to an embodiment is arranged on an input side of an image forming apparatus.

A schematic configuration of an image forming apparatus shown in FIG. 1 will be described below. FIG. 1 is a sectional view illustrating a schematic configuration of the image forming apparatus having a sheet feeding apparatus;

Referring to FIG. 1, an image forming apparatus 1 includes a printer body 1000 and a scanner 2000 arrange on an upper surface of the printer body 1000. The image forming apparatus 1 also includes a sheet feeding apparatus 3000 which feeds the sheet to the printer body 1000. The sheet feeding apparatus 3000 includes an air separating and feeding mechanism which is of a sheet separating and feeding portion in order to stably separate and feed various sheets. The sheet feeding apparatus 3000 will be described later.

First the image forming apparatus 1 will be described in detail. The scanner 2000 which reads an original includes a scanning optics light source 201, a platen glass 202, an openable original platen 203, a lens 204, a light receiving element (photoelectric conversion) 205, an image processing portion 206, and a memory portion 208. An image processing signal processed by the image processing portion 206 is stored in the memory portion 208.

In reading the original, the original placed on the platen glass 202 is irradiated with light by the scanning optics light source 201 to read the original. The read original image is processed by the image processing portion 206 and converted into an electrically-coded electric signal 207, and the electric signal 207 is transmitted to a laser scanner 111 which is of image forming unit. Alternatively, the coded image information processed by the image processing portion 206 is temporarily stored in the memory portion 208, and the image information may be transmitted to the laser scanner 111 by a signal from a control unit 130 if needed.

The printer body 1000 includes a sheet conveyance portion 1004 and the control unit 130. The sheet conveyance portion 1004 conveys the sheet fed by the sheet feeding apparatus 3000, to an image forming portion 1005. The control unit 130 controls the printer 1000.

The sheet conveyance portion 1004 includes a registration roller portion which has a pre-registration roller pair 122 and a registration roller pair 123. The sheet fed from the sheet feeding apparatus 3000 is guided by a sheet conveyance path 121 formed by a guide plate, and the sheet is led to the registration roller pair 123 after passing through the pre-registration roller pair 122. Then, the sheet once abuts on the registration roller pair 123 to correct skew feeding generated in feeding and conveying the sheet, and the sheet is conveyed to the forming portion 1005.

The image forming portion 1005 includes a photosensitive drum 112, a laser scanner 111, a development device 114, a transfer charger 115, and a separation charger 116. Informing the image, a laser beam from the laser scanner 111 is folded by a mirror 113, and an exposure position 112*a* on the photosensitive drum 112 is irradiated with the laser beam. The photosensitive drum 112 is rotated in a clockwise direction of FIG. 1. Therefore, a latent image is formed on the photosensitive drum 112. Then, the latent image formed on the photosensitive drum 112 is visualized as a toner image by the development device 114. The position irradiated with the laser beam can be changed through a laser writing position control circuit by a control signal from the control unit 130, and thereby the position where the latent image is formed on the photosensitive drum 112 can be changed in a longitudinal direction, that is, in a so-called main scanning direction.

The toner image on the photosensitive drum 112 is transferred to the sheet in a transfer portion 112*b* by the transfer charger 115. The sheet to which the toner image is transferred is electrostatically separated from the photosensitive drum 112 by the separation charger 116. Then, the sheet is conveyed to a fixing device 118 by a conveyance belt 117, and the toner image is fixed to the sheet by the fixing device 118. The sheet to which the toner image is fixed is discharged to the outside of the apparatus by a discharge roller 119. A discharge sensor 120 is provided in a conveyance path between the fixing device 118 and the discharge roller 119 to be able to detect the passage of the sheet.

In the embodiment, the printer body 1000 and the scanner 2000 are separately formed. Alternatively, the printer body 1000 and the scanner 2000 are integrally formed. In either case, the printer body 1000 functions as the copying machine when the signal processed by the scanner 2000 is inputted to the laser scanner 111, and the printer body 1000 functions as the facsimile when a facsimile transmission signal is inputted. The printer body 1000 also functions as the printer when an output signal of a personal computer is inputted.

On the contrary, the printer body 1000 functions as the facsimile when the signal processed by the image processing portion 206 of the scanner 2000 is transmitted to the above facsimile. In the scanner 2000, the original can automatically be read, when an automatic original feeding apparatus 250 shown by an alternate long and two short dashes line is attached in place of the platen 203.

(Sheet Feeding Apparatus)

Then, the sheet feeding apparatus 3000 in the image forming apparatus 1 of FIG. 1 will be described.

The sheet feeding apparatus 3000 includes a sheet feeding portion 331 located in a lower portion of the sheet feeding apparatus 3000 and a sheet feeding portion 322 located in an upper portion. The sheet feeding portions 331 and 332 include sheet accommodation portions 301 and 311 in which plural sheets S can be accommodated respectively. A tray 302 and a rear-end regulating plate 303 are provided in the sheet accommodation portion 301, and a tray 312 and the rear-end regulating plate 303 are provided in the sheet accommodation portion 311. The accommodated sheets S are loaded on each of the trays 302 and 312 which can be lifted and lowered. The rear-end regulating plate 303 regulates a rear end of the sheet S in the conveyance direction (direction of arrow A). The rear-end regulating plate 303 is movable according to the size in the conveyance direction of the sheet S, and the rear-end regulating plate 303 regulates the rear end of the sheet conveyance direction such that the front end in the sheet conveyance direction is aligned with the front-end side in the conveyance direction of the sheet accommodation portion 302. Although the sheet feeding portion 331 and 332 have the same configuration, the rear-end regulating plate is not shown on the side of the sheet feeding portion 332.

Figure 2:
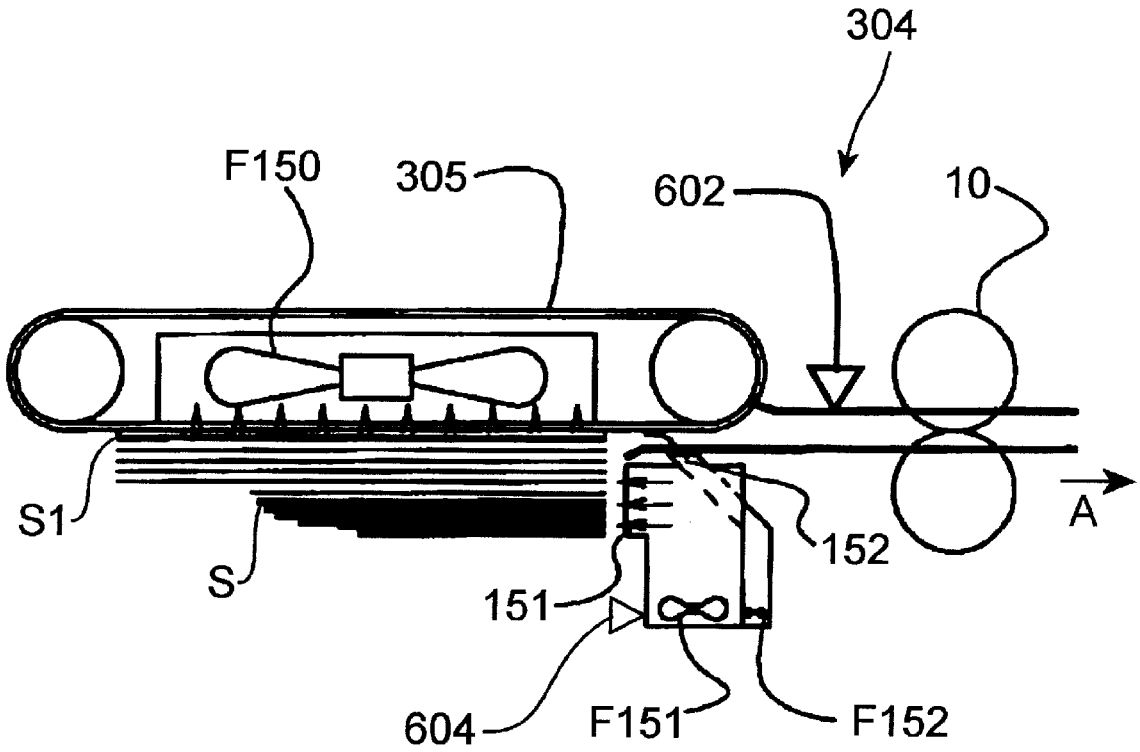
FIG. 2 is a sectional view illustrating an example of a sheet separating and feeding portion of the sheet feeding apparatus of the embodiment.

The sheet separating and feeding portion (air separating and feeding mechanism) in the sheet feeding apparatus will be described below with reference to FIG. 2. FIG. 2 is an enlarged view illustrating a main part of the sheet separating and feeding portion in the sheet feeding apparatus shown in FIG. 1.

With regard to sheets in the sheet accommodation portion 301, a loosening fan F151 is rotated as a pre-feeding operation, and thereby the air is blown from a loosening nozzle 151 which is of an air outlet to loosen with a periphery in the upper portion of the loaded sheets S in the sheet separating and feeding portion 304. When a feeding start signal is transmitted from the control unit 300, a negative pressure (suction force) is generated in a suction belt 305 by a suction fan F150, and the suction of the sheet is started. After a predetermined suction time elapses since the suction is started, only the uppermost sheet S1 in the loaded sheets S is adsorbed by the suction belt 305. After a predetermined time, in the suction belt 305, rotation is started by a suction belt motor M102 while the sheet S1 is adsorbed, and the sheet S1 is conveyed in the direction of the arrow A. When the front end of the sheet reaches a belt pulley portion, the front end portion of the sheet is released from the suction force generated by the suction fan F150, and the sheet is separated from the suction belt 305 and transferred to a drawing roller pair 10. FIG. 2 illustrates a configuration in which a separating fan F152 is provided. The separating fan F152 blows the air from a separating nozzle 152 to separate the front end portion of the sheet from the suction belt 305. When the front end of the sheet S1 reaches the drawing roller pair 10, the negative pressure generated by the suction fan F150 is released to release the sheet from the suction force to the suction belt 305, and the sheet is conveyed only by conveyance force of the drawing roller pair 10. When the feeding start signal is transmitted again by the control unit 300 after the rear end of the sheet passes through the suction belt portion, the feeding operation is started and the subsequent sheet S2 is separated and fed.

In this case, the loosening fan F151 is operated as the pre-feeding operation before the feeding start signal is transmitted. Alternatively, the loosening fan F151 may be operated after the feeding start signal is transmitted.

Although only the sheet separating and feeding portion 304 on the side of the sheet accommodation portion 301 is described, the sheet separating and feeding portion 314 is similarly provided on the side of the sheet accommodation portion 311 to perform the similar separation and feeding.

Figure 3:
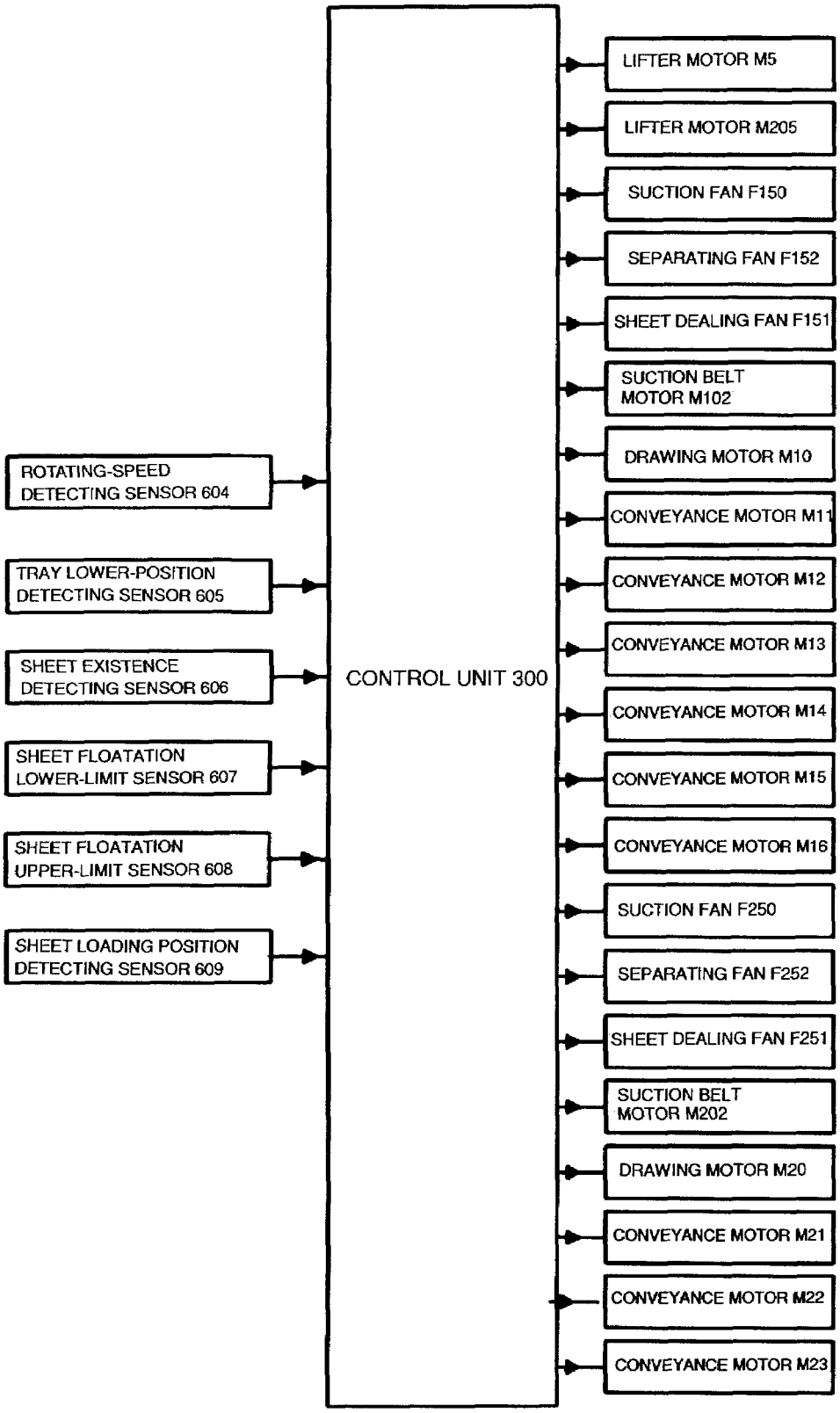
FIG. 3 illustrates a control block diagram of the sheet feeding apparatus of the embodiment.

As shown in FIG. 3, the drawing roller pairs 10 and 20 are connected to drawing motors M10 and M20 respectively. Conveyance roller pairs 11, 12, 13, 14, 15, 16, 21, 22, and 23 are connected to conveyance motors M11, M12, M13, M14, M15, M16, M21, M22, and M23 respectively. In the sheet feeding apparatus, each roller pair can independently be driven.

In FIG. 3, lifter motors M5 and M205 which are of lifter driving unit lift and lower the trays 302 and 312 in the sheet feeding portion 331 and 332 respectively. Suction belt motors M102 and M202 rotate the suction belts in the sheet feeding portion 331 and 332 respectively. Suction fans F150 and F250 suck the sheets to the suction belt in the sheet feeding portions 331 and 332 respectively. Sheet loosening fans F151 and F251 are located in the sheet feeding portions 331 and 332 respectively, and separating fans F152 and F252 are located in the sheet feeding portions 331 and 332 respectively. These operation portions are controlled by the control unit 300 which is of control unit.

In FIG. 3, a rotating-speed detecting sensor 604, which is of rotating-speed detecting unit, detects a rotating speed of the loosening fan. A tray lower-position detecting sensor 605, which is of lower-position detecting unit, detects a lower position of the tray. As used herein the lower position shall mean the lowest position where each of the trays 302 and 312 is lowered in the normal operation. A sheet existence detecting sensor 606, which is of sheet existence detection unit, detects the presence or absence of the sheet loaded on each of the trays 302 and 312. A sheet floatation lower-limit sensor 607 and a sheet floatation upper-limit sensor 608 are sensors which detect a position of the sheet floated by the air blown from the loosening fan F151. A sheet loading position detecting sensor 609 is provided in the lifting and lowering range of the tray to stop the sheet at the position higher than the lower position. The control unit 300 controls the operations of the sheet feeding apparatus based on pieces of information from various sensors.

Pieces of information such as a size, a type, and a basis weight of the sheet accommodated in the sheet accommodation portions 301 and 311 can be set from an operation portion of the image forming apparatus.

(Sheet Insertion Apparatus)

Figure 5:
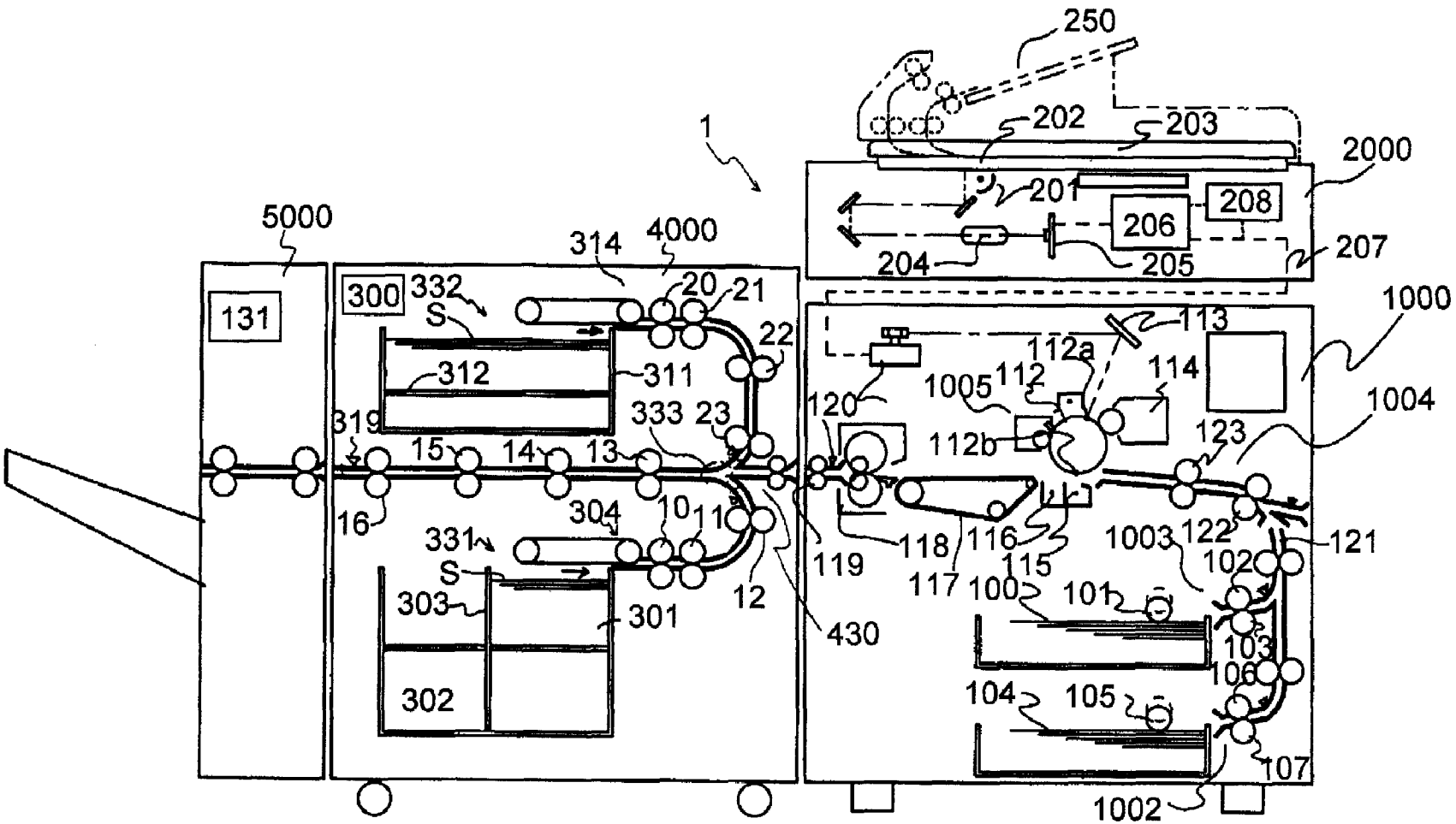
FIG. 5 is a sectional view illustrating a schematic configuration in which the sheet insertion apparatus according to an embodiment is arranged on an output side of the image forming apparatus.

Then, a schematic configuration of an image forming apparatus shown in FIG. 5 will be described below. FIG. 5 is a sectional view illustrating a schematic configuration of the image forming apparatus having the sheet feeding apparatus. In the image forming apparatus of FIG. 5, the member having the same function as the image forming apparatus of FIG. 1 is designated by the same numeral and the detailed description is neglected.

Referring to FIG. 5, the image forming apparatus 1 includes the printer body 1000 and the scanner 2000 arranged on the upper surface of the printer body 1000. The image forming apparatus 1 shown in FIG. 1 also includes a sheet insertion apparatus 4000 which is of the sheet feeding apparatus. The sheet insertion apparatus 4000 is connected to the sheet discharge side of the printer body 1000 to feed the sheet to the printer body 1000. The image forming apparatus 1 also includes a finisher 5000 which is of sheet processing apparatus. The finisher 5000 is provided on the sheet discharge side of the sheet insertion apparatus 4000.

In the image forming apparatus 1 of FIG. 5, the sheet s discharged from the printer body 1000 is led to a sheet conveyance portion 430 of the sheet insertion apparatus 4000. The sheet insertion apparatus 4000 includes the sheet feeding portion 331 located in the lower portion of the sheet feeding apparatus 4000 and the sheet feeding portion 322 located in the upper portion. The sheet conveyance portion 430 is connected to a convergent portion 333 of the sheet feeding portions 331 and 332. Because the configurations of the sheet feeding portions 331 and 332 of the sheet insertion apparatus 4000 are similar to those of the sheet feeding portions 331 and 332 of the sheet feeding apparatus 3000, the member having the same function is designated by the same numeral and the description is neglected. Each of the sheet feeding portions 331 and 332 of the sheet insertion apparatus 4000 accommodates interleaving paper, a cover, a back-side cover, and a divider of a sheet stack and sheets in which the image is already formed. The sheet separated one by one by each of the sheet feeding portions 331 and 332 is conveyed to the finisher 5000 so as to be inserted between the sheets conveyed from the printer body 1000 at the convergent portion of the midpoint of the sheet conveyance portion 430.

As described above, because the sheet feeding portions 331 and 332 have the same configuration, the sheet can be fed by selecting the necessary feeding portion as needed according to the sheet accommodated in the feeding portion. In the sheet feeding, both the sheet feeding portions 331 and 332 may be alternately be used, or one of the sheet feeding portions 331 and 332 may be continuously used.

The finisher 5000 sequentially loads and aligns the sheets conveyed through the sheet insertion apparatus 4000. Although the detailed description of the operation is neglected, the control unit 130 of the printer body 1000 and a control unit 131 of the finisher 5000 conduct communication with each other to obtain optimum conditions from pieces of information on the sheet size, the number of sheets, the type, and the like. Various processing methods can be selected in the finisher 5000. For example, a staple device (not shown) performs a binding process to each stack to be bound, or the binding process is not performed but only the sheets are loaded.

The production of the sheet stack with the image forming apparatus 1 of FIG. 5 will be described below. The case where the sheet stack including 13 sheets S1 to S13 is produced will be described by way of example. The 10 sheets S2 to S6 and S8 to S12 for text body are produced with the printer body, the previously-printed cover S1 and back-side cover S13 are added by the sheet insertion apparatus, and the divider S7 is inserted between the fifth sheet S6 for text body and the sixth sheet S8 for text body to complete the sheet stack.

The printer body 1000 of FIG. 5 includes two sheet feeding portions 1002 and 1003 in the lower portion thereof. The sheet feeding portions 1002 and 1003 have the same configuration. In the sheet feeding portions 1002 and 1003, the sheets accommodated in sheet accommodation portions 100 and 104 are selectively drawn by pickup rollers 101 and 105, the sheets are separated one by one by feed rollers 102 and 106 and retard rollers 103 and 107, and the sheet is conveyed to a sheet conveyance portion 1004.

The sheets for producing the text body are accommodated in the sheet accommodation portions 100 and 104 of the printer body 1000. The divider sheets are accommodated in the sheet accommodation portion 311 in the upper stage of the sheet insertion apparatus 4000, and the sheet stack in which the previously-printed covers and back-side covers are alternately loaded are accommodated in the sheet accommodation portion 301 in the lower stage.

Since the control unit 130 of the printer body 1000 controls not only the single printer but also the whole of the image forming apparatus, the control unit 130 of the printer body 1000 first receives a signal for producing the sheet stack when the signal for producing the sheet stack is inputted. For the signal input method, the signal may be inputted from the operation portion of the image forming apparatus 1 or the signal may be inputted from a remote computer.

When the signal for producing the sheet stack is inputted, the control unit 130 transmits the pieces of information on the number of sheets in one stack, sheet insertion timing, and the like to a control unit 300 of the sheet insertion apparatus 4000 and a control unit 131 of the finisher 5000. An operating preparation is started in each apparatus.

Specifically, in the sheet insertion apparatus 4000, the divider sheet S7 is separated and fed from the upper-stage sheet feeding portion 332, and the divider sheet S7 stands by at a standby position before the divider sheet S7 reaches the convergent portion 333 of the sheet conveyance portion 430. The cover S1 is separated and fed from the lower-stage sheet feeding portion 331, and the cover S1 stands by at a standby position before the cover S1 reaches the convergent portion 333 of the sheet conveyance portion 430.

When the operating preparation is completed in each apparatus, the cover S1 of a first set is conveyed from the standby position in the sheet insertion apparatus 4000 and, at the same time, the sheets S2 to S6 (first to fifth sheets) for text body are separated and fed at equal intervals in the printer body 1000. After a time necessary to insert the divider sheet S7 of the sheet insertion apparatus 4000, that is, after a time necessary to convey the one sheet, the sheets S8 to S12 (sixth to tenth sheets) for text body are separated and fed in the printer body 1000. After a space of the two-sheet interval of the back-side cover S13 of the first set and the cover of the second set is kept, the first to fifth sheets for text body of the second set are separated and fed in the printer body.

Thus, the images are formed while the space of the sheet inserted by the sheet insertion apparatus is kept. In the sheet insertion apparatus 4000, the sheets S2 to S6 in which the images are already formed is conveyed at a conveyance speed higher than that of the printer body. That is, the front end of each sheet passes through the discharge sensor 120, and the sheet is conveyed into the sheet insertion apparatus 4000. After the rear end of each sheet passes through the discharge roller 119, the conveyance speed is enhanced to a second conveyance speed V1 higher than a first conveyance speed V0 which is of an image forming speed.

The cover S1 which stands by in the sheet insertion apparatus 4000 is started in motion from the standby position before the first sheet S2 for text body is discharged from the printer body 1000, and the conveyance is started at the second conveyance speed V1. The speed of the conveyance roller 13 located near the convergent portion 333 in the sheet insertion apparatus 4000 is enhanced to the second conveyance speed V1 during the conveyance of the cover S1. When the rear end of the cover S1 passes through the conveyance roller 13, the sheet insertion apparatus 4000 reduces the conveyance speed to the first conveyance speed V0 which is of the discharge speed of the printer body 1000 in order to prepare the transfer of the sheet for text body from the printer body 100.

As described above, in the sheet insertion apparatus 4000, the sheets S2 to S6 for text body are conveyed while the speed is enhanced. The enhancement of the sheet conveyance speed is ended before the rear end of the sheet for text body reaches the convergent portion 333 of the conveyance path. Therefore, the divider S7 which stands by at the standby position in the sheet insertion apparatus 4000 is started in conveyance at the second conveyance speed V1 after the rear end of the sheet S6 for text body passes through the convergent portion 333, and the divider S7 is inserted between the sheet S6 and the next sheet S7 discharged from the printer body. Thus, the sheet passing through the convergent portion 333 in the sheet insertion apparatus 4000 is conveyed at the second conveyance speed V1. Although the sheet is conveyed at the second conveyance speed V1 in the sheet insertion apparatus 4000, the speed of the sheet is reduced to the first conveyance speed V0 when the front end of the sheet passes through the discharge sensor 319 of the sheet insertion apparatus 4000, and the sheet is transferred to the finisher 5000. That is, the sheet insertion apparatus 4000 reduces the conveyance speed again to the first conveyance speed V0 which is of the image forming speed in order to prepare the transfer of the sheet from the printer body 1000.

After the divider S7 is conveyed, in the sheet insertion apparatus, the sheets S8 to S12 for text body are conveyed in the same manner as the sheets S2 to S6. As with the divider S7, the back-side cover S13 which is stands by at the standby position in the sheet insertion apparatus 4000 is started in conveyance at the second conveyance speed V1 after the rear end of the sheet S12 for text body passes through the convergent portion 333. The back-side cover S13 is separated and fed from the sheet accommodation portion 301 until the sheet S12 is delivered to the sheet insertion apparatus 4000 since the sheet S1 is conveyed, and the back-side cover S13 stands by at the standby position in front of the convergent portion.

Then, in the case where the next sheet stack is similarly processed, unless the back-side cover S13 is conveyed, the rear end of the back-side cover S13 blocks the cover S14 of the next stack, and the suction of the cover S14 cannot be started in the sheet separating and feeding portion. Therefore, after the time (suction time) when the rear end of the back-side cover S13 is separated from the belt elapses since the conveyance of the back-side cover S13 is started, the suction and conveyance of the cover S14 is started.

(Control Block)

Figure 4:
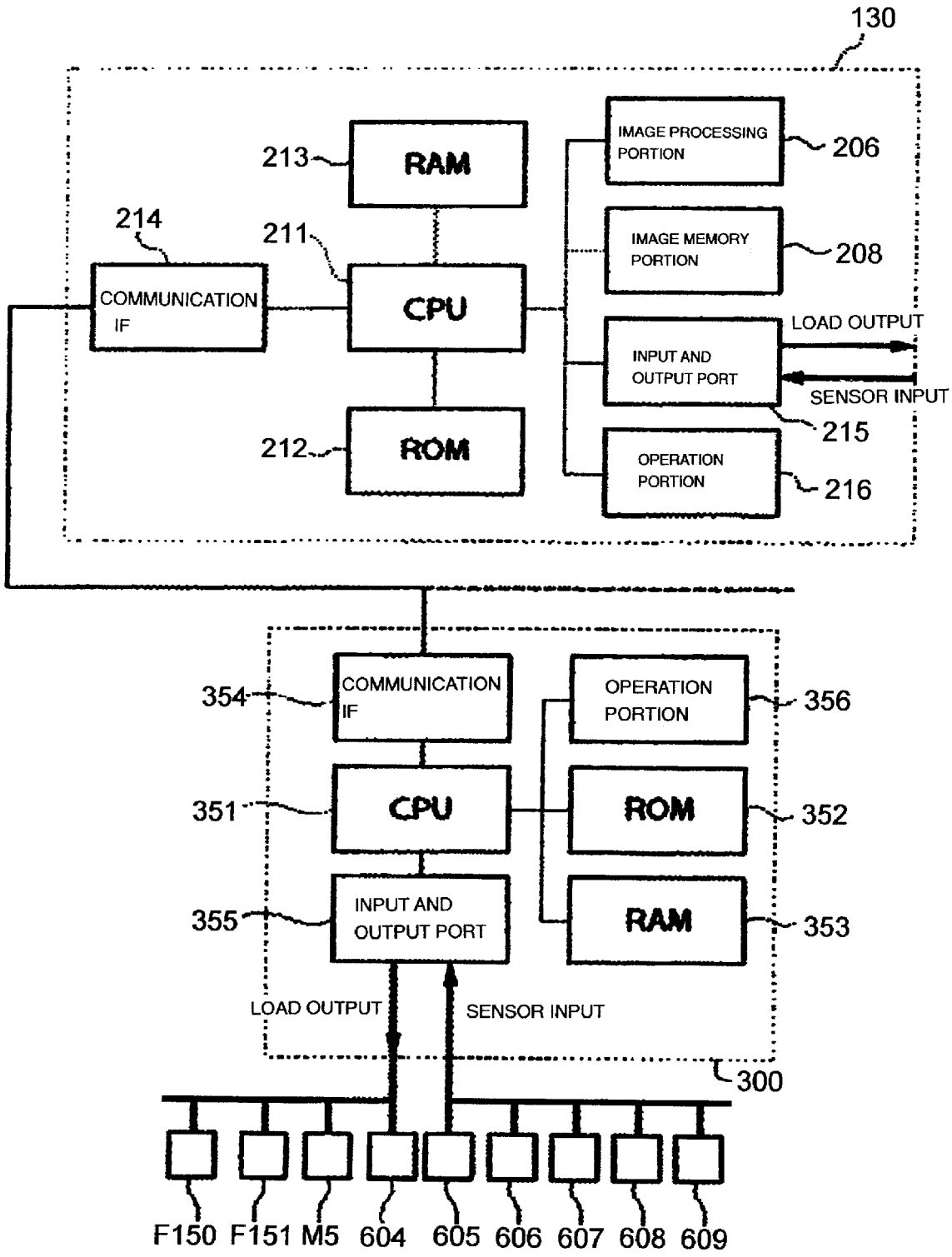
FIG. 4 is a block diagram illustrating configurations of a control unit of a printer body of the embodiment and a control unit of the sheet feeding apparatus of the embodiment.

FIG. 4 is a block diagram illustrating configurations of the control unit 130 of the printer body 1000 and the control unit 300 of the sheet feeding apparatus 3000 shown in FIG. 1. In FIG. 5, the configurations of the control unit 130 in the printer body 1000 and the control unit 300 in the sheet insertion apparatus 4000 are similar to those of FIG. 4.

The control unit 130 in the printer body 1000 includes CPU 211, ROM 212, RAM 213, a communication interface (I/F) 214, an input and output port 215, an operation portion 216, an image processing portion 206, and an image memory portion 208.

CPU 211 performs basic control of the printer body 1000. CPU 211 is connected to ROM 212 in which a control program is written, a working RAM 213 which is used to perform the processing, and the input and output port 215 through an address bus and a data bus. A part of the region of RAM 213 is used as a backup RAM in which data is not erased even if the power is turned off. Various load devices such as motors and clutches which are controlled by the printer body 1000 and various inputs devices such as a sensor for detecting the position of the sheet are connected to the input and output port 215.

CPU 211 sequentially controls input and output through the input and output port 215 to perform the image forming process according to contents of the control program stored in ROM 212. The operation portion 216 is connected to CPU 211 such that CPU 211 controls a display portion and a key input portion of the operation portion 216. A user provides an instruction of an image forming operating mode or display exchange to CPU 211 through the key input portion, and CPU 211 causes the display portion of the operation portion 216 to display an operating status of the printer body 1000 or an operating mode set by key input. The image processing portion 206 and the image memory portion 208 are connected to CPU 211. The image processing portion 206 processes the signal which is converted into the electric signal by the image sensor portion (light receiving element) 205. The processed image is stored in the image memory portion 208.

In order to realize the operation described with reference to FIG. 1, the control unit 300 of the sheet feeding apparatus 3000 includes CPU 351, ROM 352, RAM 353, a communication interface (I/F) 354, an input and output port 355, and an operation portion 356. Detection results are inputted to CPU 351 through the input and output port 355 from a floatation upper-limit sensor 608 and a floatation lower-limit sensor 607 which will be described later, the rotating-speed detecting sensor 604, the tray lower-position detecting sensor 605, and the sheet existence detecting sensor 606. On the basis of the detection results, CPU 351 outputs a drive command to lifter motor M5 and M205, the loosening fan F151 and F251, and the suction fans F150 and F250. The floatation upper-limit sensor 608 is arranged above the floatation lower-limit sensor 607. A distance measuring sensor (not shown) which can measure a distance may be used in place of the floatation upper-limit sensor and the floatation lower-limit sensor.

(Operation Portion)

Figure 6:
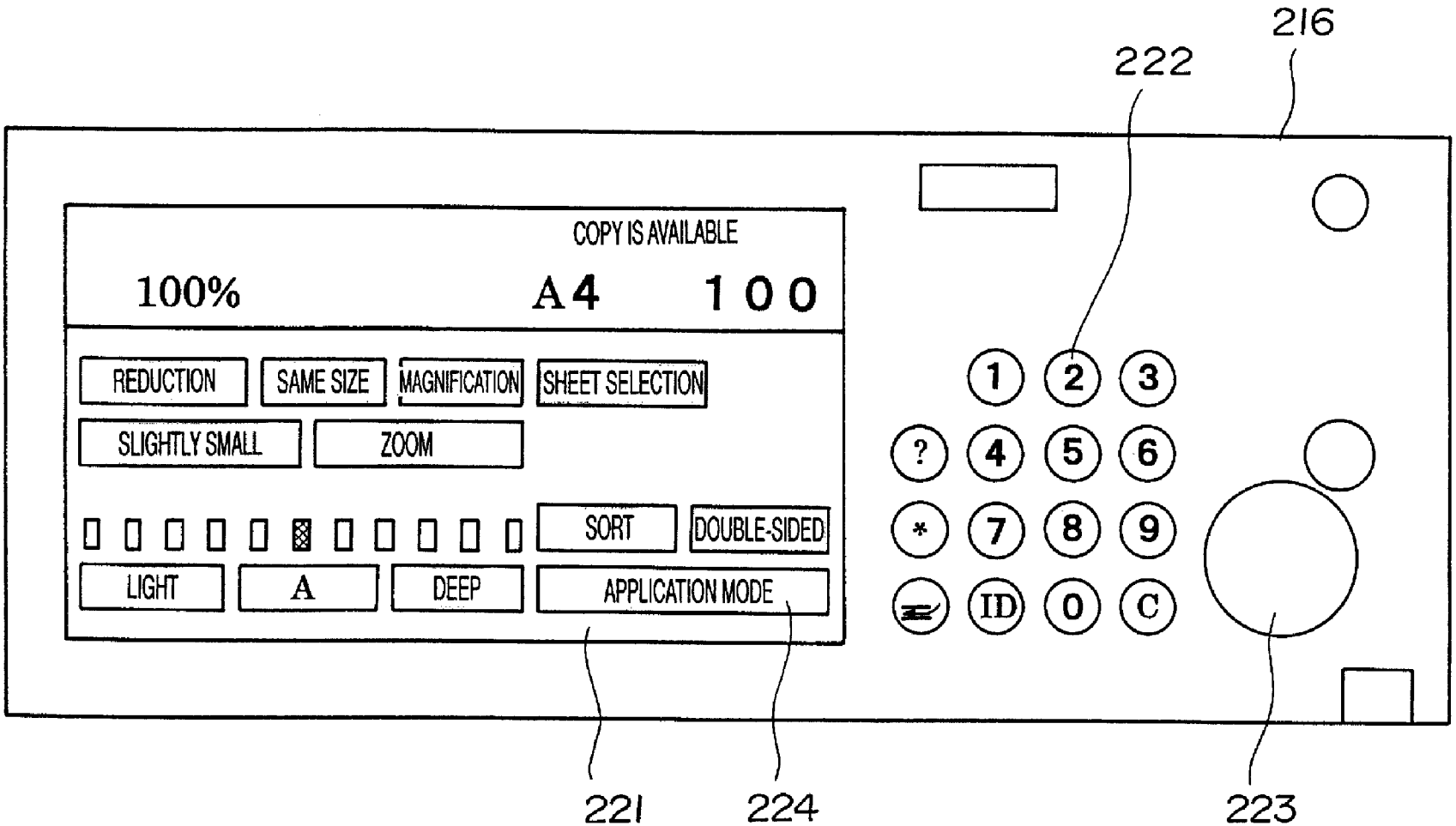
FIG. 6 illustrates a schematic configuration of an operation portion of the sheet feeding apparatus of the embodiment.

FIG. 6 is a schematic view illustrating a configuration of an operation portion in the image forming apparatus of the embodiment.

Referring to FIG. 6, a display portion 221 displays various messages such as the operating status of the apparatus and a working instruction to a user and a working procedure. A surface of the display portion 221 is formed by a touch panel which acts as a selection key by touching the surface. A ten key 222 is used to input a figure. A start key 223 is used to start the copy action when the start key 223 is pressed. An application mode selection key 224 is used to input sheet conditions such as a material of the sheet surface, the basis weight, and surface smoothness.

Figure 7:
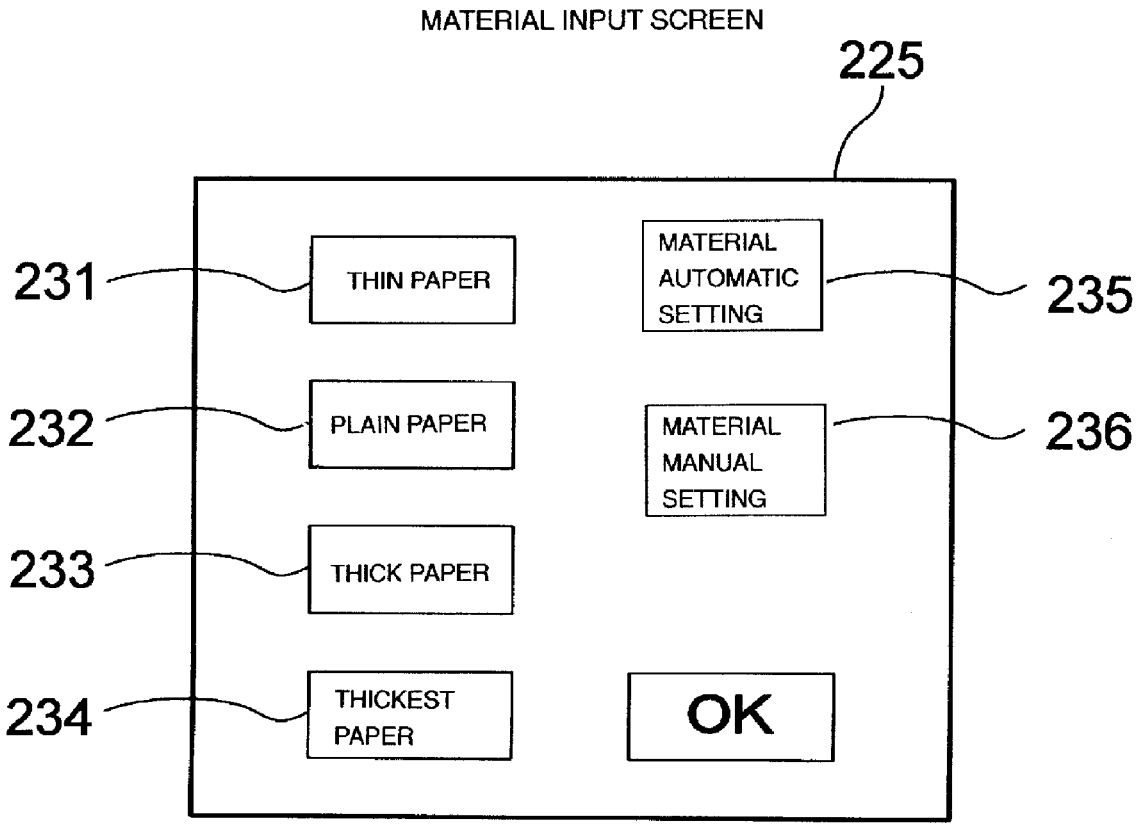
FIG. 7 illustrates a screen in which sheet conditions are inputted on an operation screen.

For example, the sheet material accommodated in the sheet feeding apparatus 3000 is selected from the display portion (operation screen) 225 shown in FIG. 7. In this case, thin paper 231, plain paper 232, thick paper 233, and thickest paper 234 are illustrated as specific materials of the sheet. The material may be automatically set (the numeral 235 in FIG. 7). The sheet conditions such as the material of the sheet surface, the basis weight, and the surface smoothness may be set in detail (the numeral 236 in FIG. 7).

The control unit 300 of the sheet feeding apparatus 3000 has a table. The table is used to change the rotating speeds of the loosening fans F151 and F251 to obtain the optimum sheet loosening air according to the setting of the sheet material conditions (basis weight, surface roughness, and the like) through the display portion 225 of FIG. 7. When the setting is not performed, the plain paper 232 is usually used. Additionally, detailed setting may be added in addition to the setting items of the display portion shown in FIG. 7.

(Sheet Separating and Feeding Portion)

The configuration of the sheet separating and feeding portion (air separating and feeding mechanism) included in the sheet feeding portion will be described below.

Figure 9:
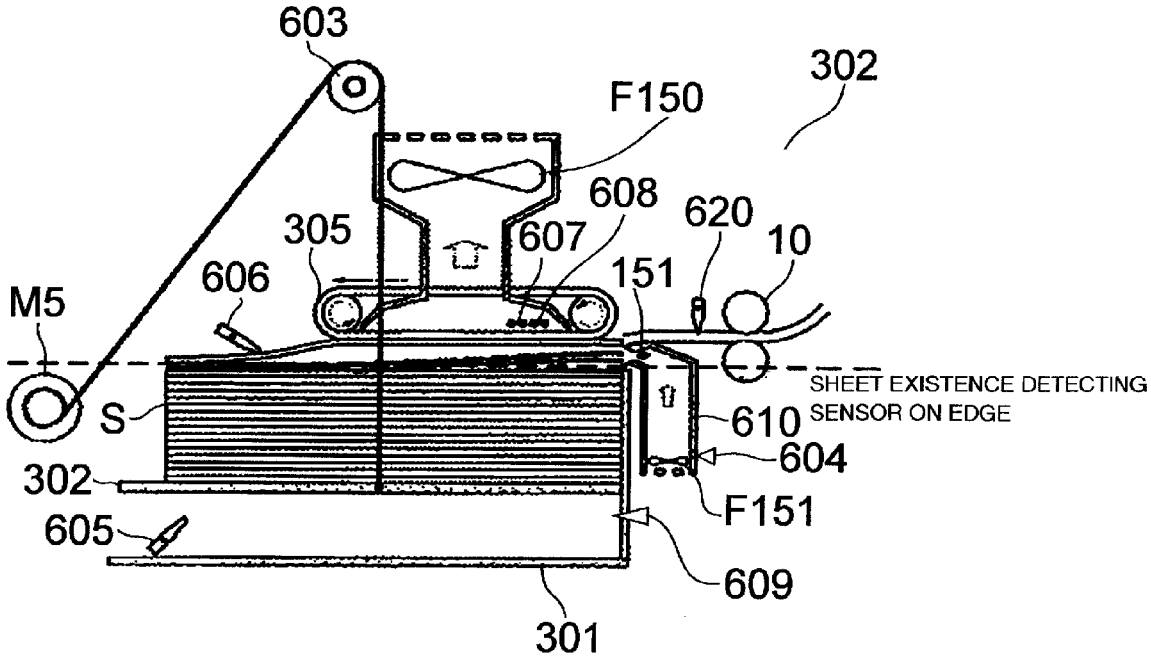
FIG. 9 is a sectional view illustrating an example of a sheet separating and feeding portion of the sheet feeding apparatus according to the embodiment.

FIG. 9 is a sectional view illustrating a configuration of the sheet separating and feeding portion in the sheet feeding apparatus and a peripheral portion of the sheet accommodation portion. Although FIG. 2 illustrates the configuration in which the suction fan F150 is arranged in the suction belt 305, the suction fan F150 may be arranged outside the suction belt 305 as shown in FIG. 9.

FIG. 9 illustrates the sheet separating and feeding portion 304 of the sheet feeding portion 331 in the sheet feeding apparatus 3000 of FIG. 1, and the sheet feeding portion 332 in the sheet feeding apparatus 3000 and the sheet feeding portion in the sheet insertion apparatus 4000 have the similar configurations. The sheet feeding portion 1002 and 1003 in the printer body 1000 of FIG. 5 is an example of retard type separating and feeding mechanism. Alternatively, an air separating and feeding mechanism with an adsorption conveyance belt may be used.

In FIG. 9, the tray 302 which lifts and lowers the sheet stack including the loaded sheets S can vertically be moved through a pulley 603 by driving the lifter motor M5. An encoder is attached to the lifter motor M5, and the amount of drive of the lifter motor M5, that is, the amount of movement of the tray 302 can be detected by the encoder. The moving direction of the tray 302 can be detected by the rotational direction of the encoder or the control signal of the motor.

The tray lower-position detecting sensor 605 is arranged to detect the lower position of the tray 302. On the other hand, the sheet existence detecting sensor 606, the sheet floatation lower-limit sensor 607, and the sheet floatation upper-limit sensor 608 are arranged in the upper portion of the sheet separating and feeding portion 304 to detect a height of the sheet. The sheet existence detecting sensor 606 is a flag sensor for detecting the sheet, and the sheet floatation lower-limit sensor 607 and the sheet floatation upper-limit sensor 608 are an optical sensor for detecting the sheet. The sheet existence detecting sensor 606 is arranged below the sheet floatation lower-limit sensor 607 and the sheet floatation upper-limit sensor 608. When the sheets S loaded on the tray 302 is lifted to the feeding start position, the sheet existence detecting sensor 606 can detect the upper surface of the sheet stack prior to the sheet floatation lower-limit sensor 607 and the sheet floatation upper-limit sensor 608.

The sheet floatation lower-limit sensor 607 and the sheet floatation upper-limit sensor 608 detect the position of the sheet floatation by the air from the loosening fan F151. In the sheet floatation lower-limit sensor 607, sensitivity is adjusted so as to detect the floating sheet located below the sheet floatation upper-limit sensor 608. Therefore, using the sheet floatation lower-limit sensor 607 and the sheet floatation upper-limit sensor 608, it is possible to detect whether or not the floating sheet is located within a predetermined range. A relationship between the detection states of the sheet floatation lower-limit sensor 607 and sheet floatation upper-limit sensor 608 and the sheet state will be described later.

The loosening fan F151 and a loosening fan duct 610 are provided to loosen with the sheet S accommodated in the sheet accommodation portion 301 in advance of the feeding operation. A wind pressure in a discharge direction generated by the rotation of the loosening fan F151 is imparted to the periphery of the uppermost sheet of the sheet stack S through the loosening fan duct 610, which prevents the plural sheets from being fed at once (overlap feeding) during the sheet feeding operation.

The suction belt 305, the suction fan F150 and a suction fan duct 613 are provided as the sheet feeding mechanism. The wind pressure in a suction direction generated by the rotation of the loosening fan F150 is imparted to the suction belt 305 through the suction fan duct 613, which adsorbs the uppermost sheet of the sheet stack S. The sheet adsorbed to the suction belt 305 is conveyed onto the sides of a feeding retry sensor 620 and the drawing roller pair 10 by the rotation of the suction belt 305 in the direction of the arrow of FIG. 9.

Figure 10:
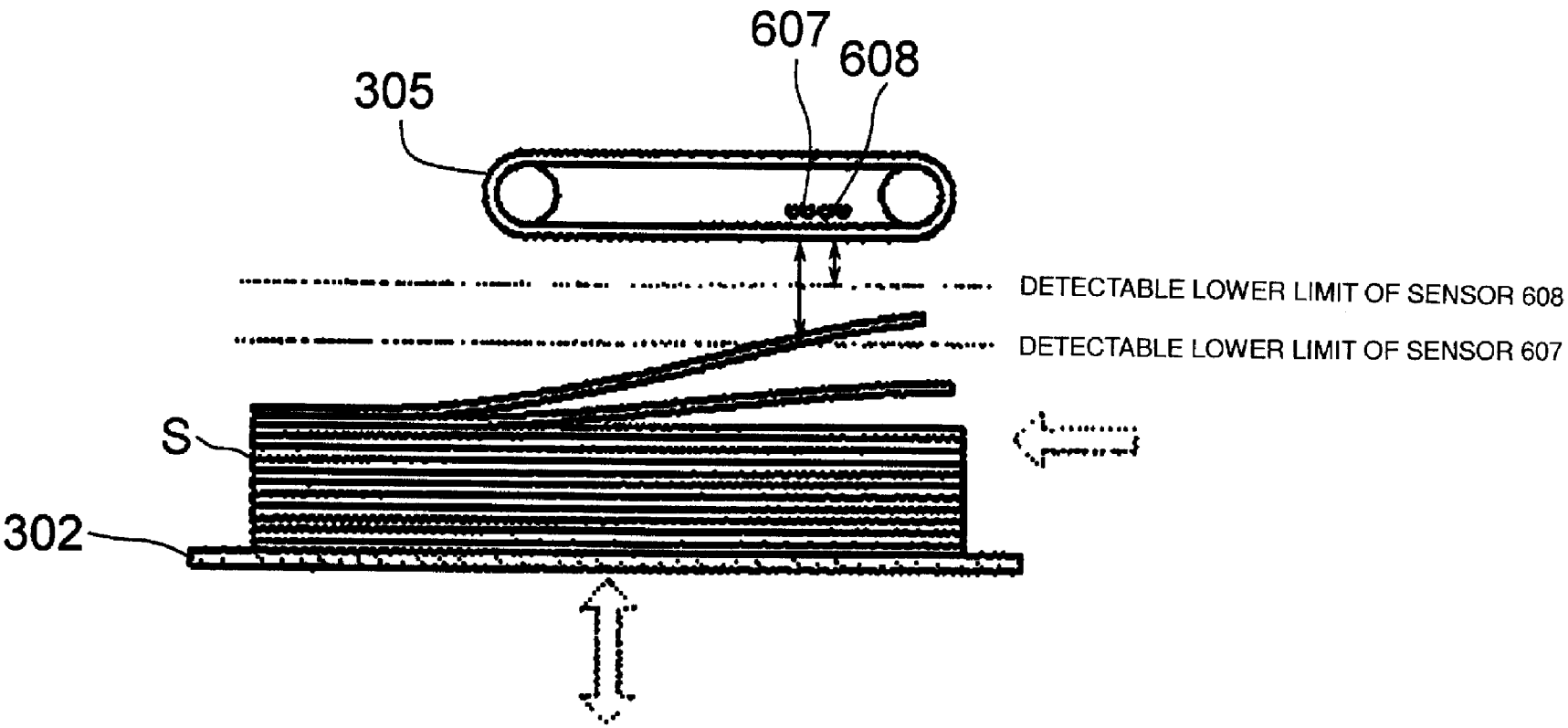
FIG. 10 illustrates detectable lower limits of a sheet floatation upper-limit sensor and a sheet floatation lower-limit sensor.

FIG. 9 illustrates the state in which the sheet is adsorbed by the suction fan F150. The sheet floatation lower-limit sensor 607 and the sheet floatation upper-limit sensor 608 detect the sheet floatation position while the loosening fan F151 is operated. As shown in FIG. 10, the lifting and lowering of the tray 302 are controlled based on the sheet floatation lower-limit sensor 607 and the sheet floatation upper-limit sensor 608 while the suction fan F150 is not operated but the loosening fan F151 is operated. In the state in which both the suction fan F150 and the loosening fan F151 are not operated, the standby position of the sheet stack S may be set to on-edge (detecting position) of the sheet floatation lower-limit sensor 607 (detecting position) or to on-edge of the sheet existence detecting sensor 606.

In FIG. 9, the sheet existence detecting sensor 606 detects the presence or absence of the sheet on the tray 302, and the on-edge (shown by a dotted line of FIG. 9) of the sheet existence detecting sensor 606 is arranged below the loosening nozzle 151 which is of the air outlet of the loosening fan duct 610. When the loosening fan F151 is not operated, the stop position (standby position) of the tray 302 is located at the on-edge of the sheet existence detecting sensor 606. The sheet loading sensor 609 is arranged in the mid point of the lifting and lowering range of the tray 302. In the case where the sheet existence detecting sensor 606 detects the absence of the sheet, the sheet loading position detecting sensor 609 detects the tray 302 to output a signal for stopping the tray 302 when the tray 302 is lowered to the lower position. Thus, the tray 302 is not lowered to the lower position but the tray 302 is stopped to be able to load the sheets, which improves the workability in loading the sheets. When the sheets of one package (500 sheets) are loaded on the tray 302, the tray 302 is controlled so as to be lowered until the sheet loading position detecting sensor 609 detects the uppermost surface of the loaded sheets, and thereby the upper surface position of the sheets is always kept constant. Therefore, the workability is improved because the sheets can always be loaded at the same height position.

Figure 11A:
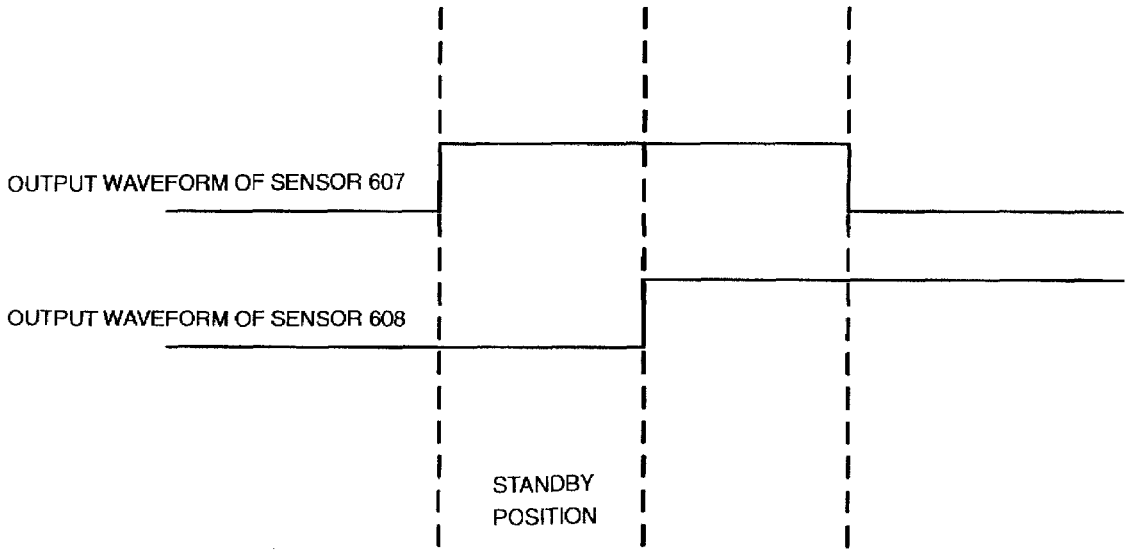
FIG. 11A illustrates logic of the sheet floatation upper-limit sensor and the sheet floatation lower-limit sensor in a standby state.
Figure 11B:
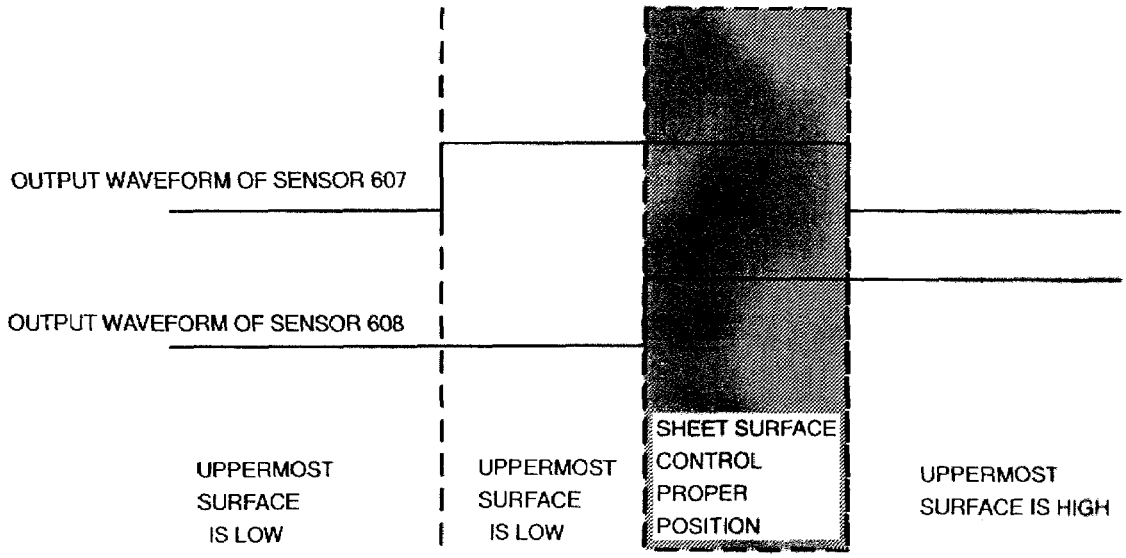
FIG. 11B illustrates logic of the sheet floatation upper-limit sensor and the sheet floatation lower-limit sensor after a loosening fan is operated.

FIGS. 11A and 11B show logic of the sheet floatation lower-limit sensor 607 and the sheet floatation upper-limit sensor 608. In the non-operating states of both the suction fan F150 and the loosening fan F151, assuming that the standby position of the sheet stack S is the on-edge of the sheet floatation lower-limit sensor 607, this state becomes the standby state of the sheet stack S. In this state of things, when the loosening fan F151 is driven, several sheets in the upper portion of the sheet stack S are loosened with, and the uppermost sheet of the sheet stack S floats. Then, the lifting and lowering of the tray 302 are controlled such that the floating sheet is located between the sheet floatation lower-limit sensor 607 and the sheet floatation upper-limit sensor 608.

FIG. 10 illustrates the detectable lower limits of the sheet floatation lower-limit sensor 607 and sheet floatation upper-limit sensor 608. In FIGS. 9 and 10, the sheet floatation lower-limit sensor 607 and the sheet floatation upper-limit sensor 608 are arrayed in the sheet feeding direction. However, the correct detection can be achieved by arraying the sheet floatation lower-limit sensor 607 and the sheet floatation upper-limit sensor 608 in the direction perpendicular to the sheet feeding direction.

Figure 12A:
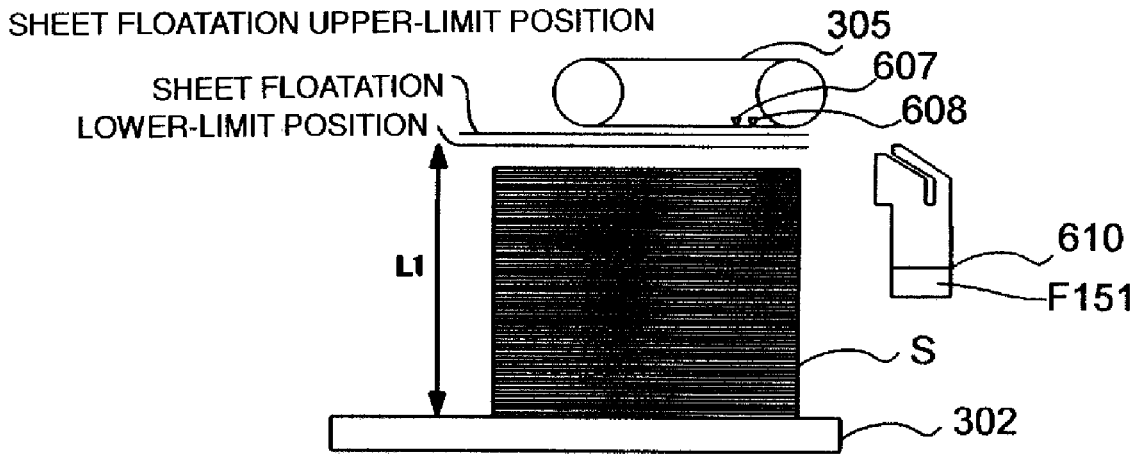
FIGS. 12A to 12C illustrate control of an uppermost sheet surface in the normal case.
Figure 12B:
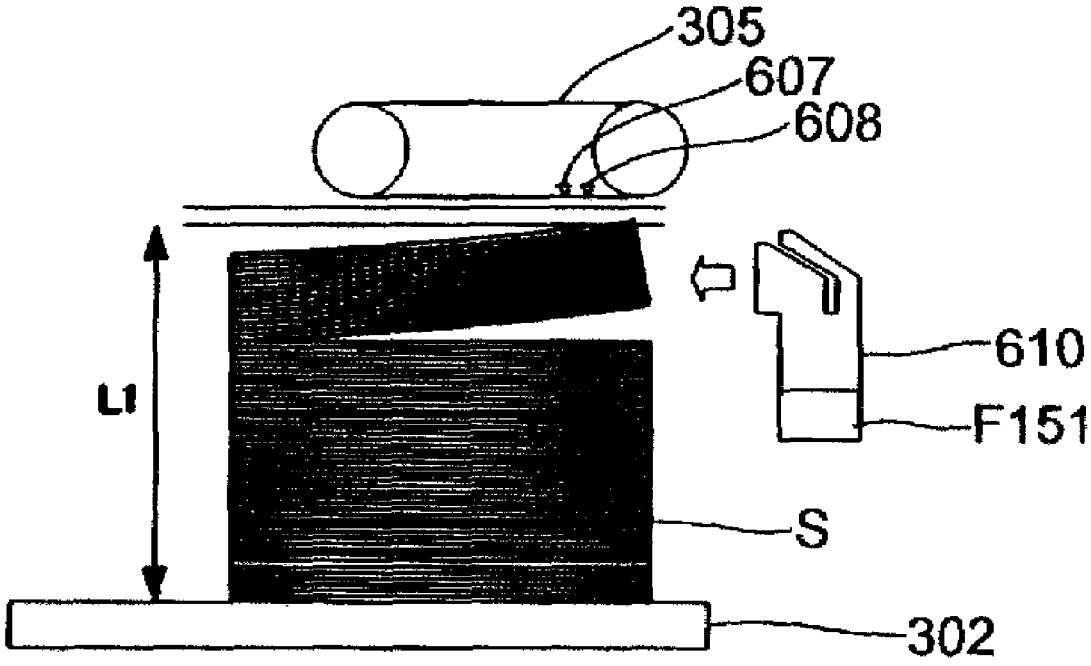
Figure 12C:
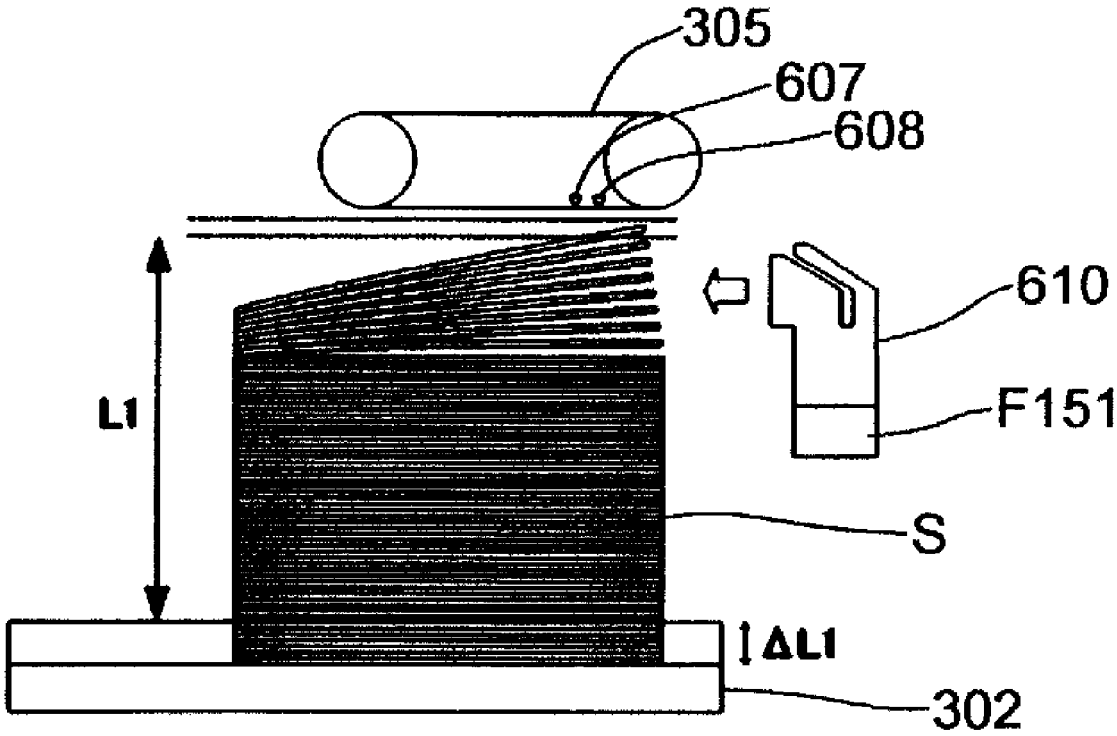

When the sheet conditions such as the surface material, the basis weight, and the surface smoothness of the sheet loaded on the tray 302 are inputted from the operation screen 225 of FIG. 7, the rotating speed of the loosening fan F151 is set such that an air quantity of the loosening fan F151 becomes optimum. When the loosening fan F151 is operated under the inputted sheet conditions, obviously the uppermost sheet of the sheet stack S is moved between the sheet floatation lower-limit sensor 607 and the sheet floatation upper-limit sensor 608 without performing the lifting and lowering operation of the tray 302. Alternatively, the uppermost sheet of the sheet stack S is moved above the sheet floatation upper-limit sensor 608. Thus, the sheet floatation lower-limit sensor 607 and the sheet floatation upper-limit sensor 608 are arranged at the position where the sheet floatation lower-limit sensor 607 and the sheet floatation upper-limit sensor 608 can detect the floating sheet without performing the lifting and lowering operation of the tray 302 when the loosening fan F151 is operated at the optimum rotating speed according to the sheet material. As shown in FIG. 12, when the sheet conditions set on the operation screen correspond to the conditions of the sheet loaded on the tray 302, the tray 302 is controlled so as to be finally lowered by ΔL1.

(Adjustment Mode of Loosening Fan)

An adjustment mode in which the rotating speed of the loosening fan F151 is stabilized will be described below with reference to FIGS. 9 and 13. The control is performed such that the loosening fan F151 transfers to the adjustment mode after the power is turned on, after predetermined number of sheets are conveyed by the sheet feeding apparatus 3000, or after a predetermined time elapses. The predetermined number of sheets may be the previously-set number of sheets or the number of sheets inputted from the operation screen. In the case where job operation is continued after the predetermined number of sheets are conveyed by the sheet feeding apparatus 3000, the control may be performed such that the loosening fan F151 transfers to the adjustment mode after the job is ended, or before the job is started. Although the one loosening fan F151 is used in the embodiment, the plural loosening fans F151 may be used. In the suction fan F150, the control may be performed such that the suction fan F150 transfers to the adjustment mode. A counter (measuring unit, not shown) which counts a rise edge or a fall edge of the signal output from the retry sensor 620 is provided in the control unit 300 (CPU 351) for the number of sheets fed by the sheet feeding apparatus 3000.

Figure 13A:
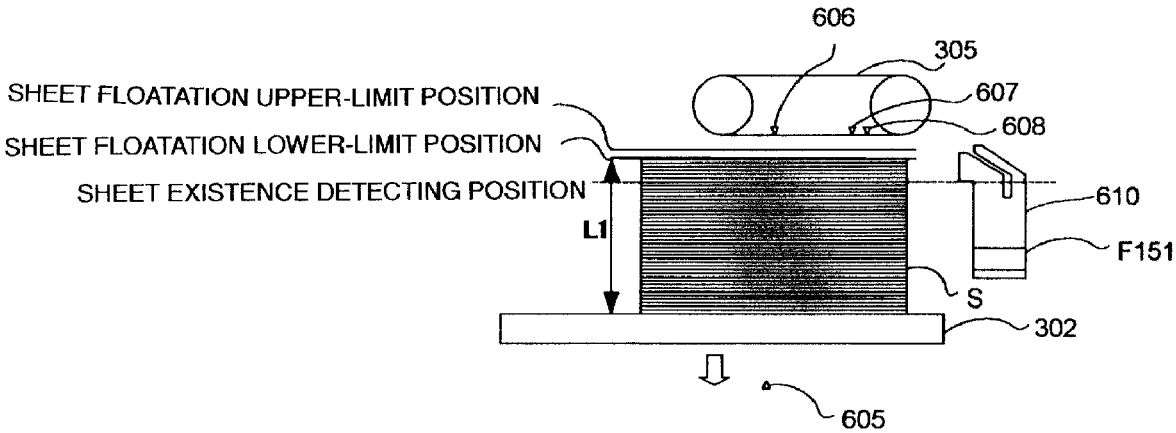
FIGS. 13A to 13C illustrate cases where a fan rotating speed can be adjusted.
Figure 13B:
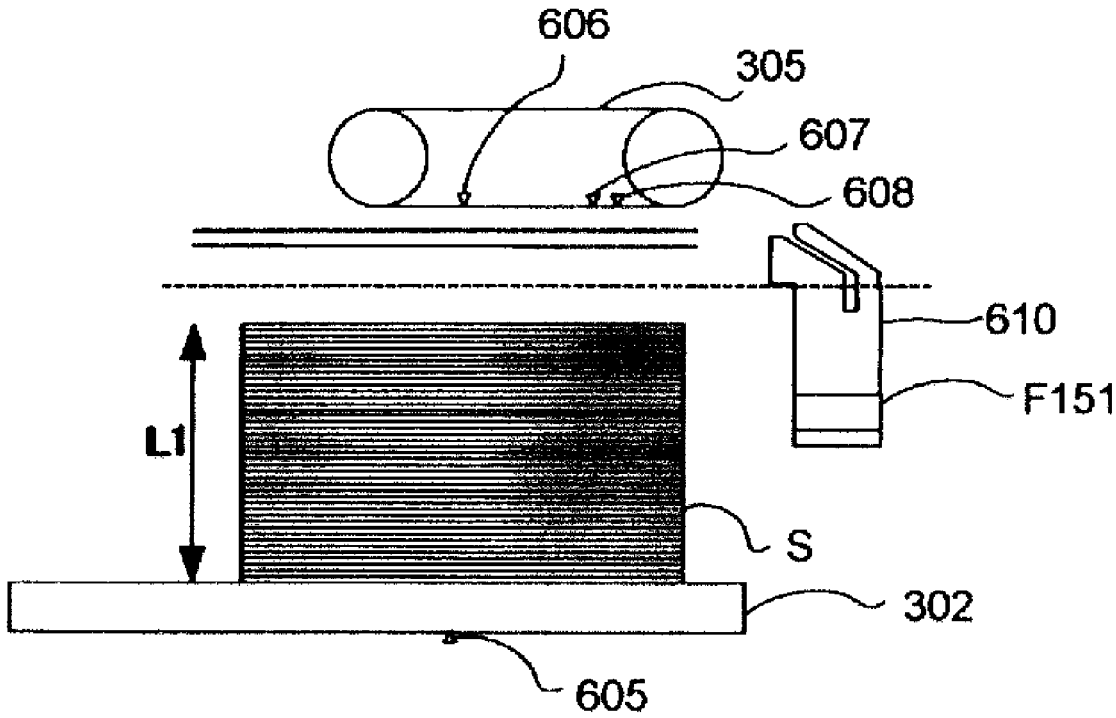
Figure 13C:
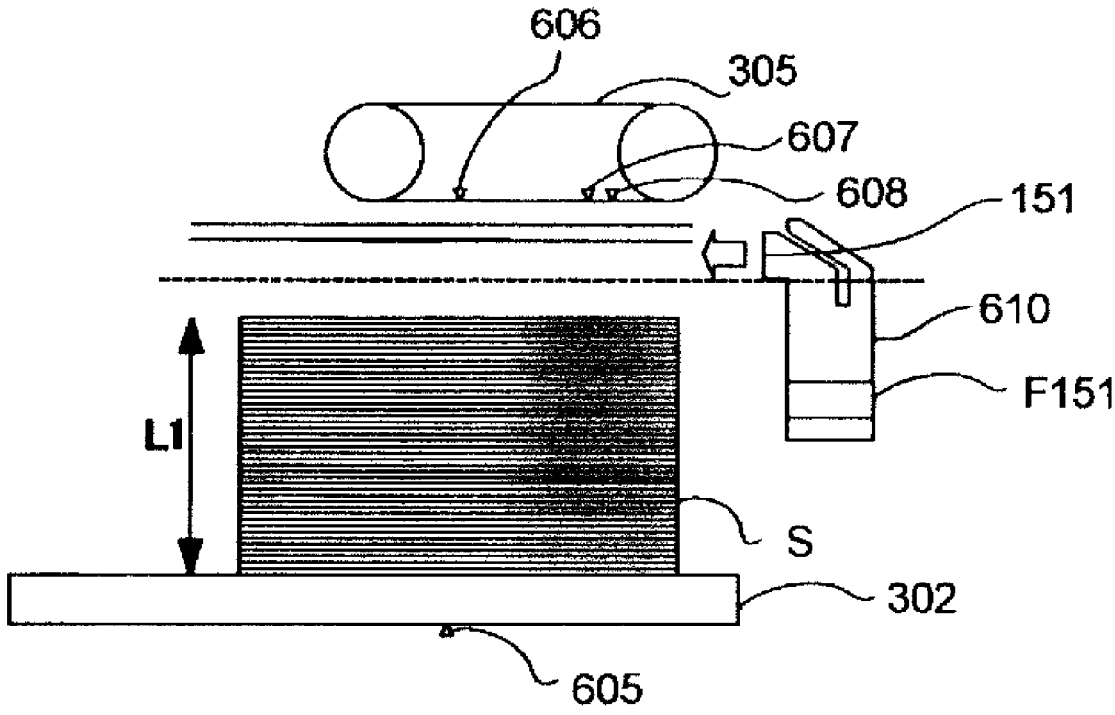

Referring to FIG. 13, when an adjustment mode transfer signal is detected after the power is turned on, after predetermined number of sheets are conveyed by the sheet feeding apparatus 3000, or after a predetermined time elapses, the lifter motor M5 (lifter drive unit) starts the lowering operation of the tray 302 (see FIG. 13A). When the lower-position detecting sensor 605 detects the tray 302, the lifter motor M5 is controlled so as to be stopped to stop the tray 302 (see FIG. 13B). At this point, unless the sheet existence detecting sensor 606 detects the sheet, the loosening fan F151 is driven, and the adjustment of the fan rotating speed is started after a predetermined time elapses (see FIG. 13C). In order to correctly adjust the rotating speed of the loosening fan F151, it is necessary that the obstacles (shielding object) be removed in front (on the extended line in the air blowing direction) of the air outlet (loosening nozzle 151) of the loosening fan F151. For example, the sheet stack S loaded on the tray 302 is located on an extended line of the air outlet of the loosening nozzle 151 of the loosening fan F151, because air flow passage of the loosening fan F151 is interrupted, the rotating speed, the air quantity, and the wind pressure cannot correctly be obtained. Therefore, the lifter motor M5 lowers the tray 302, and the lifter motor M5 is stopped when the lower-position detecting sensor 605 detects the tray 302. At this point, unless the sheet existence detecting sensor 606 detects the sheet, it is possible to make a determination that the obstacle does not exist in front of the loosening nozzle 151 (on the extended line of the air outlet), so that the rotating speed of the loosening fan F151 can be adjusted.

The adjustment of the rotating speed of the loosening fan F151 will be described with reference to FIG. 15. In a fan whose rotating speed can be monitored, a target value is required to adjust the rotating speed of the fan. When the fan is rotated in the setting of predetermined PWM (Pulse Width Modulation), it is previously found that a predetermined rotating speed (FG) output and a predetermined wind pressure are obtained from fan characteristics. For example, when a fan is operated at PWM of 100%, the rotating speed (FG) output of 600 Hz is obtained, and the wind pressure of 1000 Pa is obtained. When the wind pressure of 840 Pa is necessary for the adjustment of the fan rotating speed, the target fan rotating speed is set to 500 Hz, and a range of the target value is set such that a target upper-limit value is set to 502 Hz while a target lower-limit value is set to 498 Hz. The control is performed such that the fan rotating speed is adjusted after a predetermined time elapses since the fan operation is started, which results in PWM of 90% after the fan adjustment is normally ended, for example. The reason why the after predetermined time elapses since the fan operation is started is that the fan rotating speed is stabilized, as described above. After the fan rotating speed is stabilized, the rotating speed is adjusted, and the PWM value of the fan is changed such that the fan rotating speed (FG) becomes a predetermined value. Examples of the fan rotating-speed adjustment method includes a method of decreasing the PWM value in each predetermined value after the fan is rotated at the PWM value of 100% and a method of increasing and decreasing the PWM value by a value in which a difference between the target value and the actual rotating speed is multiplied by a coefficient. In adjusting the fan rotating speed, the control may be performed such that the fan is not rotated at 100% of the PWM value but the fan is rotated at predetermined PWM setting value.

The state in which the PWM value of the loosening fan is changed depending on the sheet conditions after the adjustment of the rotating speed of the loosening fan is normally ended will be described with reference to FIG. 8. FIG. 8 illustrates the coefficients only by way of example, and the coefficient can be changed according to the sheet conditions. As described above, when the PWM value of 90% is obtained to satisfy the wind pressure of 840 Pa necessary for the adjustment value of the loosening fan, the thickest sheet can be loosened with. That is, when the thickest sheet is selected, the PWM value of the loosening fan is set to 90%×1.0=90%. When the thick paper is selected, the PWM value of the loosening fan is set to 90%×0.75=67.5%. When the plain paper is selected, the PWM value of the loosening fan is set to 90%×0.5=45%. When the thin paper is selected, the PWM value of the loosening fan is set to 90%×0.25=22.5%.

Figure 14A:
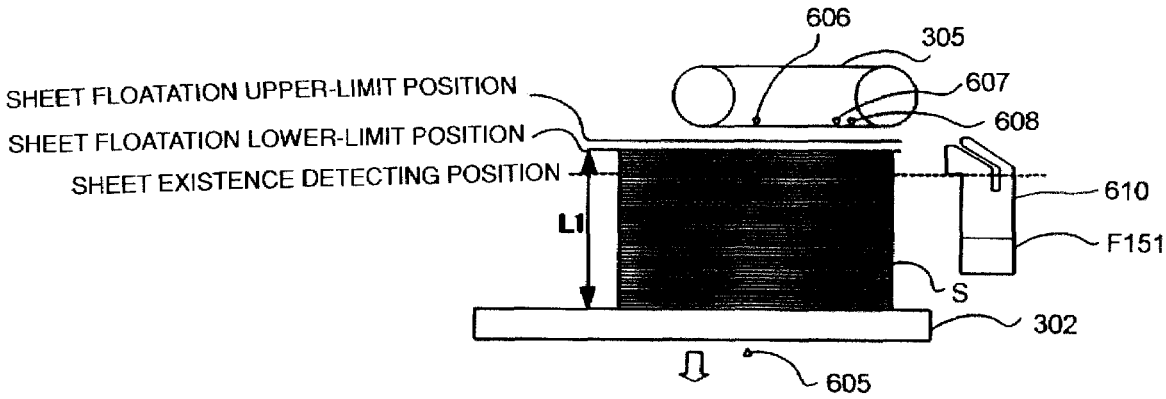
FIGS. 14A to 14C illustrate cases where the fan rotating speed cannot be adjusted.
Figure 14B:
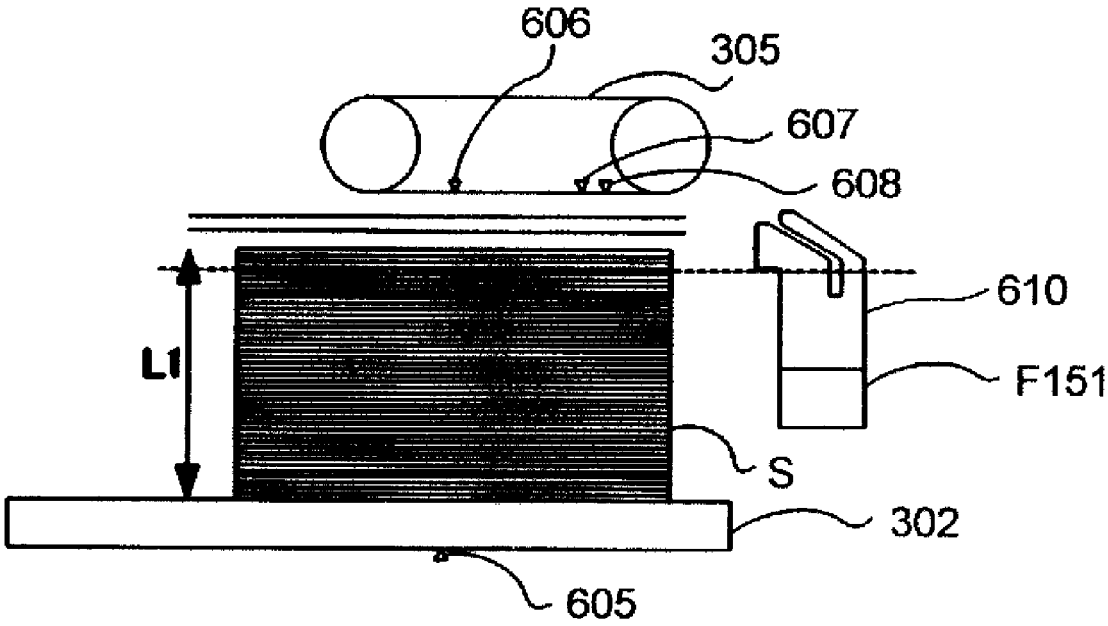
Figure 14C:
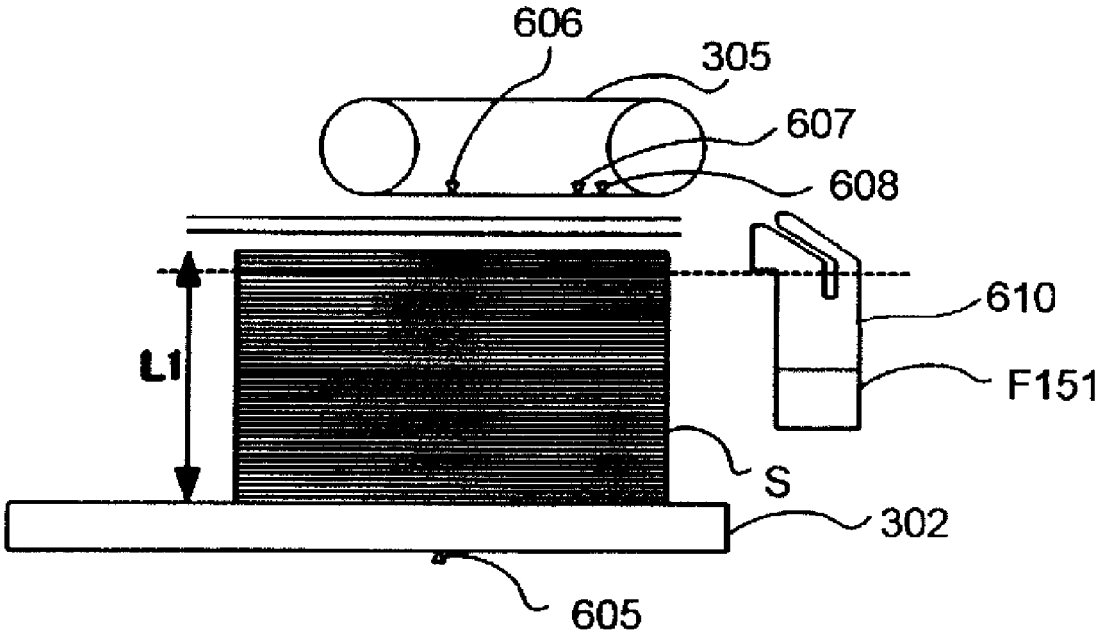
Figure 18:
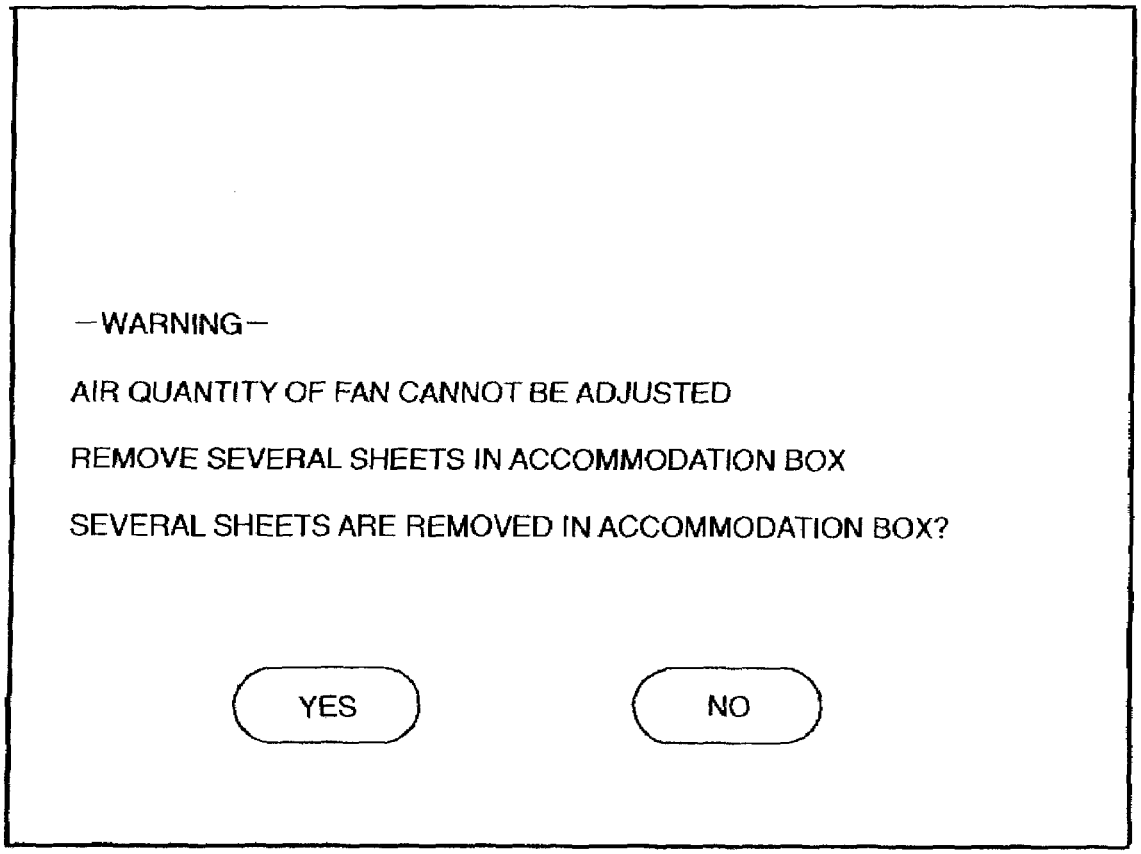
FIG. 18 illustrates warning on the operation screen before the fan rotating speed is adjusted.

Then, the case in which the fan rotating speed cannot be adjusted will be described with reference to FIG. 14. When the adjustment mode transfer signal is detected after the power is turned on, after predetermined number of sheets are conveyed by the sheet feeding apparatus 3000, or after the predetermined time elapses, the lifter motor M5 starts the lowering operation of the tray 302 (see FIG. 14A). When the lower-position detecting sensor 605 detects the tray 302, the lifter motor M5 is controlled so as to be stopped to stop the tray 302 (see FIG. 14B). At this point, when the sheet existence detecting sensor 606 detects the sheet (see FIG. 14C), a warning shown in FIG. 18 is displayed on the operation screen. Then, the sheet accommodation portion is opened to remove the several sheets loaded on the tray 302, and the sheet accommodation portion is closed again, which starts the lowering operation of the tray 302 again. When the lower-position detecting sensor 605 detects the tray 302, the lifter motor M5 is stopped to stop the tray 302. At this point, unless the sheet existence detecting sensor 606 detects the sheet, the loosening fan F151 is driven, and the adjustment of the fan rotating speed is started after the predetermined time elapses.

Figure 16:
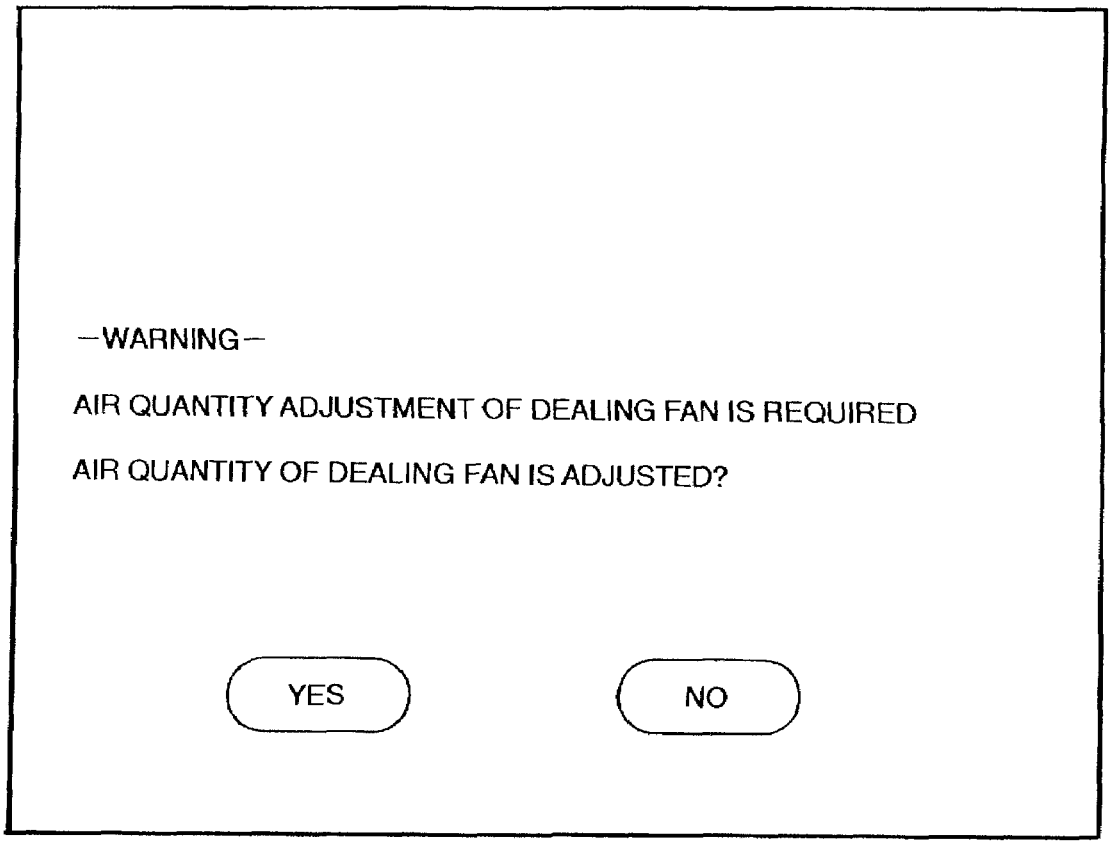
FIG. 16 illustrates selection whether or not an air quantity is adjusted from an operation screen.

For the adjustment mode in which the fan rotating speed is stabilized, the adjustment mode may be selected from the operation screen as shown in FIG. 16.

Figure 20A:
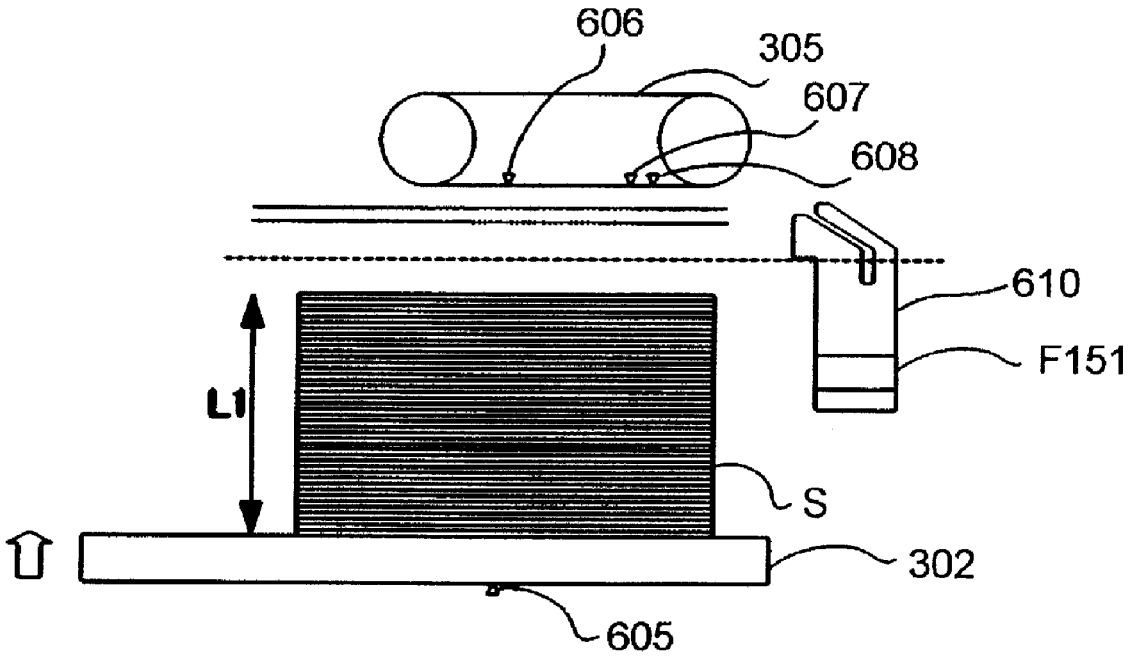
FIGS. 20A and 20B illustrate operation after the adjustment of the fan rotating speed is normally ended.
Figure 20B:
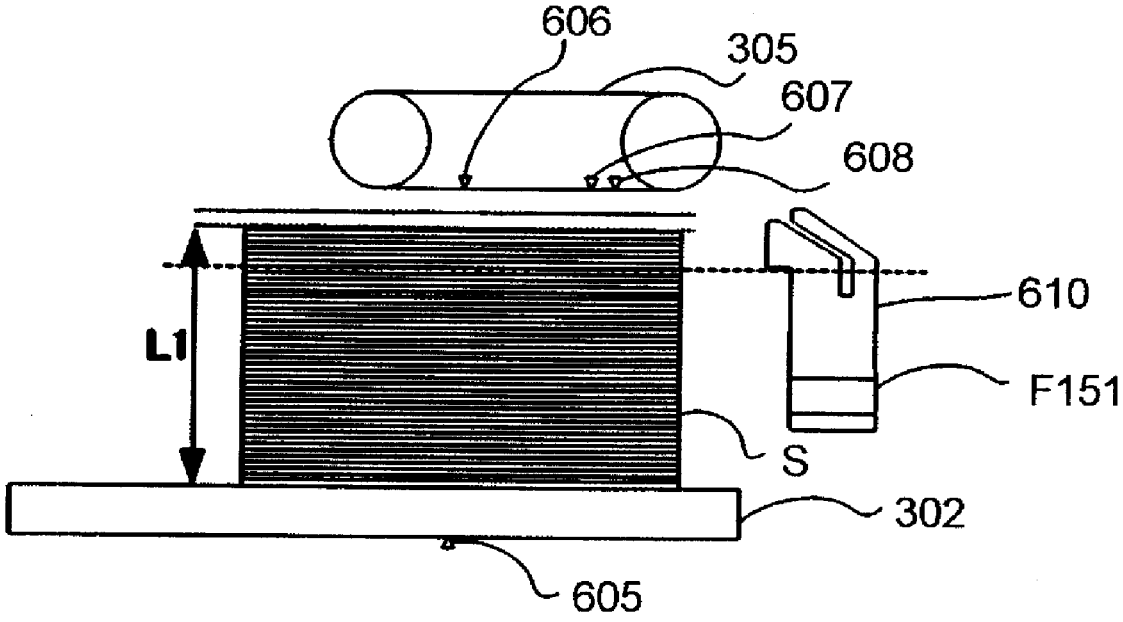

Then, the operation after the adjustment of the air quantity of the loosening fan F151 is started will be described with reference to FIG. 20. In the case where the air quantity falls within the range of the target value shown in FIG. 15 within a predetermined time since the adjustment of the air quantity of the loosening fan F151 is started, the adjustment of the air quantity of the loosening fan F151 is ended, and the fan operation is stopped. At the same time, the lifter motor M5 lifts the tray 302, and the lifter motor M5 is stopped when the floatation lower-limit sensor 607 detects the upper surface of the sheets loaded on the tray 302.

Figure 19:
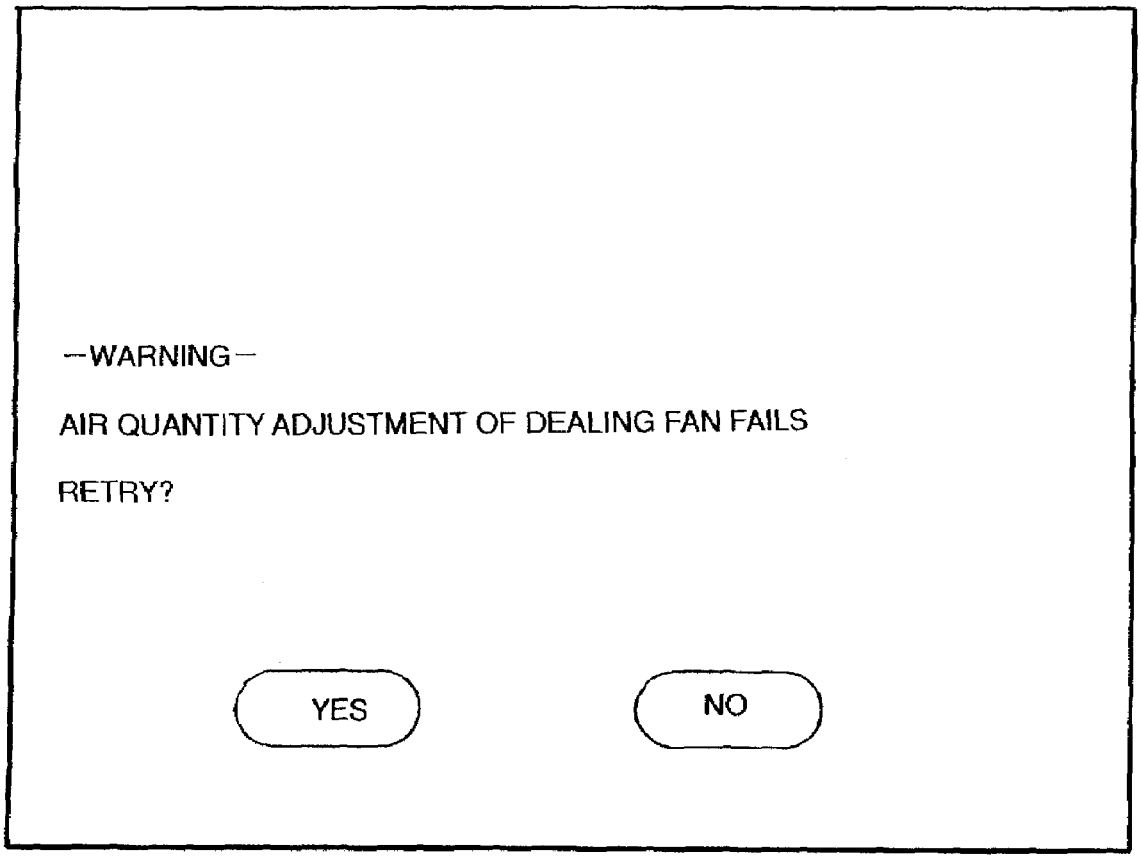
FIG. 19 illustrates warning on the operation screen when the adjustment of the fan rotating speed fails.

On the other hand, in the case where the air quantity does not fall within the range of the target value shown in FIG. 15 within a predetermined time since the adjustment of the air quantity of the loosening fan F151 is started, the rotating speed adjustment of the loosening fan F151 is ended, and the operation of the loosening fan F151 is stopped. Then, as shown in FIG. 19, a warning indicating that the rotating speed adjustment of the fan fails is displayed. In FIG. 19, the rotating speed of the fan is adjusted again. Alternatively, an error message may be displayed. The warning indicating that the rotating speed adjustment fails may be displayed before operation stop timing of the loosening fan F151.

When the sheets are loaded on the tray 302 during the air quantity adjustment of the loosing fan F151 as described above, the sheet may be blown up by the air running around to the back of the sheet, even if the sheets are not located in front of the air blown from the loosing fan F151. Particularly, for the light-weight sheet, the small sheet, and the sheet whose end portion is curled upward, the air invades between the sheets to blow high up the sheet. Accordingly, sometimes the adjustment cannot accurately be performed.

Therefore, a control portion 300 may adjust the loosing fan F151 while the sheets are not loaded on the tray 302.

With reference to the specific adjusting method, the sheet accommodation portion is opened to take out all the sheets loaded on the tray 302. Then, tray 102 is lifted when the sheet accommodation portion is closed again. Because the sheet existence detecting sensor 606 detects no sheet, the tray 302 is lowered until the sheet loading position detecting sensor 609 detects the tray 302. In this state of things, the rotating speed of the loosing fan F151 can be adjusted because the tray 302 is not located in front of the loosing nozzle 151.

Alternatively, the rotating speed of the loosing fan F151 may be adjusted when the tray 302 runs out of sheets. When the tray 302 runs out of sheets, the tray 102 is lifted, and the sheet existence detecting sensor 606 detects no sheet. Therefore, the tray 302 is lowered until the sheet loading position detecting sensor 609 detects the tray 302. Similarly, in this state of things, the rotating speed of the loosing fan F151 is adjusted. In this case, the frequency of the rotating speed adjustment is not a sort of thing that the adjustment is performed in each time the tray 302 runs out of sheets. Therefore, for example, a status of use (such as time and the number of sheets) is counted, and the rotating speed may be adjusted when the number of times of the sheet absence reaches the predetermined number of times.

The rotating speed of the loosing fan F151 may be adjusted when the apparatus is turned on to recognize that the tray 302 runs out of sheets. For example, in the case where the remaining amount of sheet is detected by the position of the tray (specifically, an encoder is attached to the drive motor to count the pulses), in order to reset a counter to perform initialization, it is necessary that the tray be lowered once to the lowest position. Then, the tray 302 is lifted, and the sheet existence detecting sensor 606 detects no sheet. Therefore, the tray 302 is lowered until the sheet loading position detecting sensor 609 detects the tray 302. Similarly, in this state of things, the rotating speed of the loosing fan F151 is adjusted.

Thus, the rotating speed of the loosing fan F151 is surely adjusted, when the rotating speed of the loosing fan F151 is adjusted while the sheets are not loaded on the tray 302.

(Timing Chart of Adjustment Mode)

Then, the operation timing concerning the adjustment mode will be described with reference to a timing chart of FIG. 21

The operations of the sheet feeding apparatus 3000 and loosening fan F151 after the loosening fan F151 is transferred to the adjustment mode after the power is turned on, after predetermined number of sheets are conveyed by the sheet feeding apparatus 3000, or after a predetermined time elapses, will mainly be described.

Figure 21:
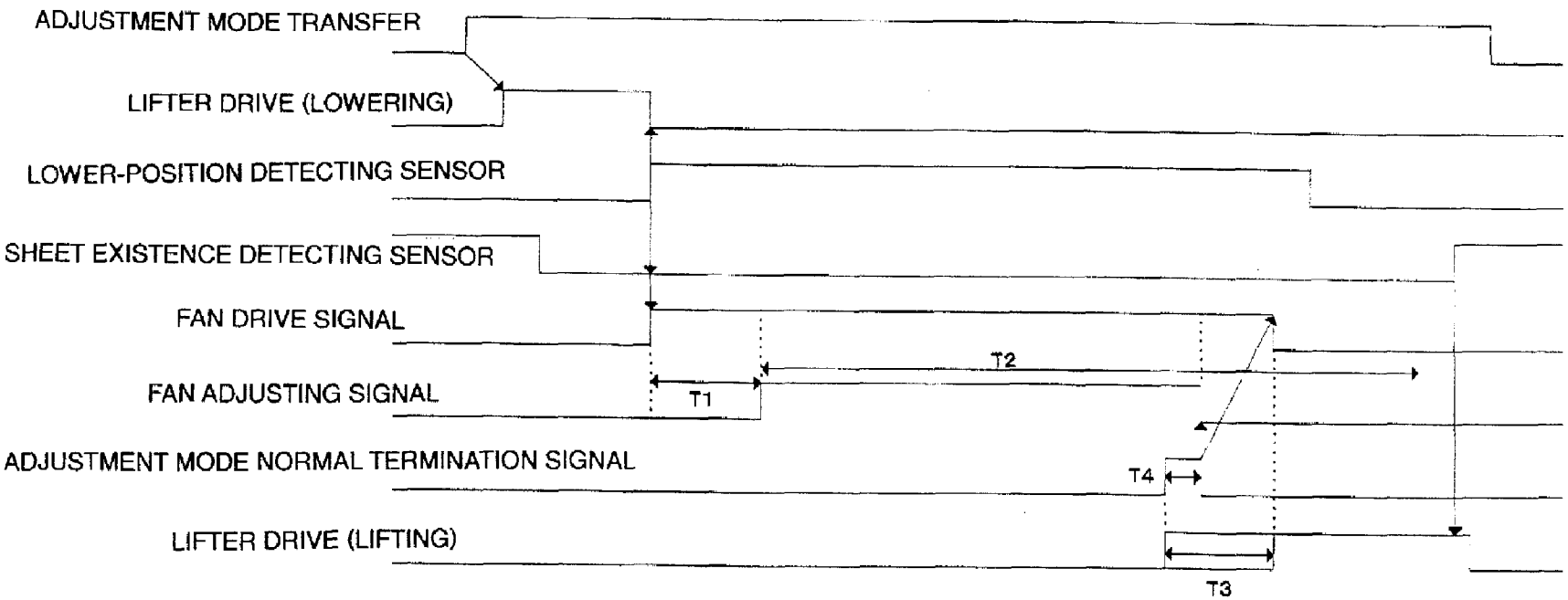
FIG. 21 illustrates a timing chart from start of the adjustment of the fan rotating speed to the normal end.

In FIG. 21, all the devices are activated by the H (high) active signal (detected by H signal, operated by H signal, and enabled by H signal). However, the devices may be activated by the L (low) active signal (detected by L signal, operated by L signal, and enabled by L signal).

When the adjustment signal becomes H (active) to enter the rotating-speed adjustment mode of the loosening fan F151, the lifter motor M5 is controlled to start the lifting and lowering operation of the tray 302. When the lift motor M5 is stopped and the tray 302 reaches the lower-position detecting sensor 605, the lifter motor M5 is stopped. When the sheet existence detecting sensor 606 detects the absence of the sheet, the loosening fan F151 is driven. The rotating speed adjustment of the loosening fan F151 is started after a predetermined time T1 elapses since the operation of the loosening fan F151 is started. The rotating speed adjustment of the loosening fan F151 is performed for a predetermined time T2. In the case where the rotating speed of the loosening fan F151 falls within the predetermined range of the target value within the predetermined time T2, the rotating speed adjustment of the loosening fan F151 is ended, and the operation of the loosening fan F151 is stopped. The determination whether or not the rotating speed of the loosening fan F151 falls within the predetermined range of the target value can be made based on the state of an adjustment mode normal termination signal. In FIG. 21, the rotating speed adjustment is ended after the H level of the adjustment mode normal termination signal is continued for a time T4. Alternatively, the determination that the adjustment mode is normally ended may be made when the H level of the adjustment mode normal termination signal is continued by the predetermined number of times for a predetermined interval. FIG. 21 illustrates the state in which the rotating speed adjustment is ended within the predetermined time T2. Then, the tray 302 is lifted, and the lifter motor M5 is stopped to stop the tray 302 when the sheet existence detecting sensor 606 detects the presence of the sheet, which transfers to the standby state. Therefore, the feeding can be started in response to the feeding start signal. In FIG. 21, the raising start timing of the tray 302 may be set at any point of the interval (T3) between the turn-on of the adjustment mode normal termination signal and the turn-off of the fan drive signal. In FIG. 21, a transfer state shown by an arrow may be generated at the same time or with delay.

Figure 22:
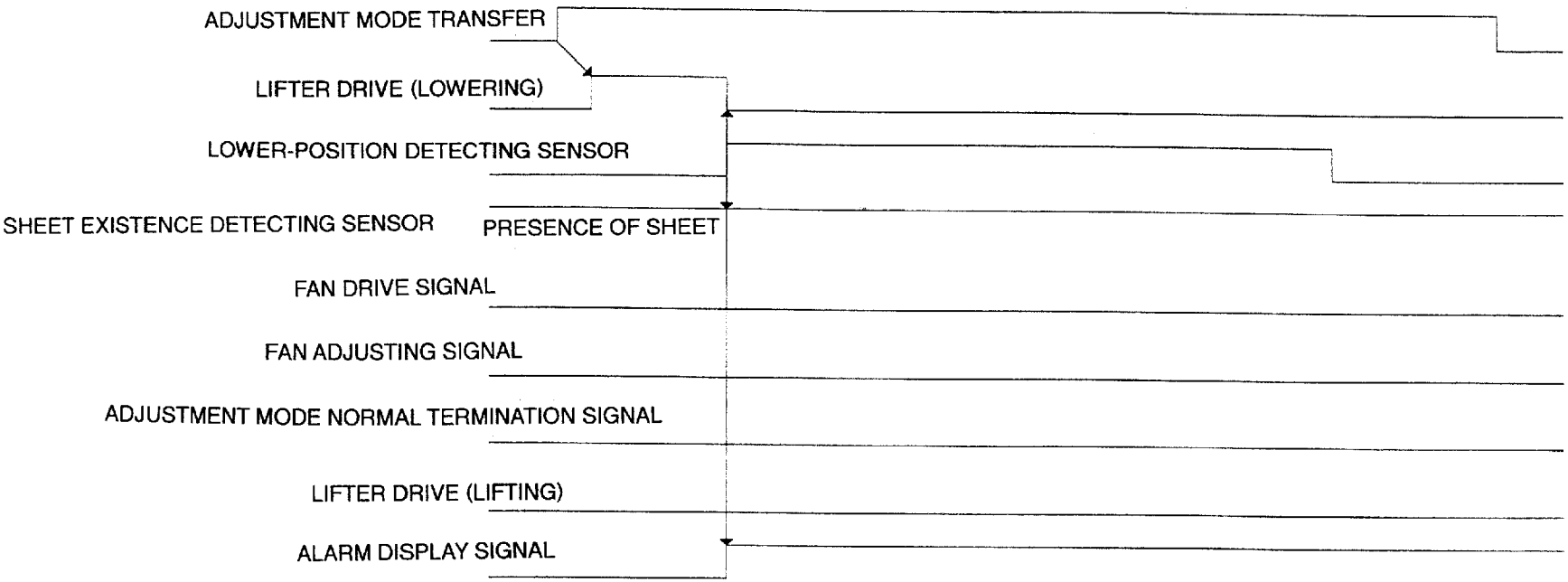
FIG. 22 illustrates a timing chart when the fan rotating speed is not adjusted.

The case in which the rotating speed adjustment mode of the fan is not transferred will be described with reference to FIG. 22. When the adjustment signal becomes H (active) to enter the rotating-speed adjustment mode of the loosening fan F151, the lifter motor M5 which lifts and lowers the tray 302 is controlled to start the lowering operation of the tray 302. When the tray 302 reaches the lower-position detecting sensor 605, the lifter motor M5 is stopped. When the lifter motor M5 is stopped and the sheet existence detecting sensor 606 detects the presence of the sheet, an alarm display signal is turned on to display the warning shown in FIG. 18 on the operation screen.

Figure 23:
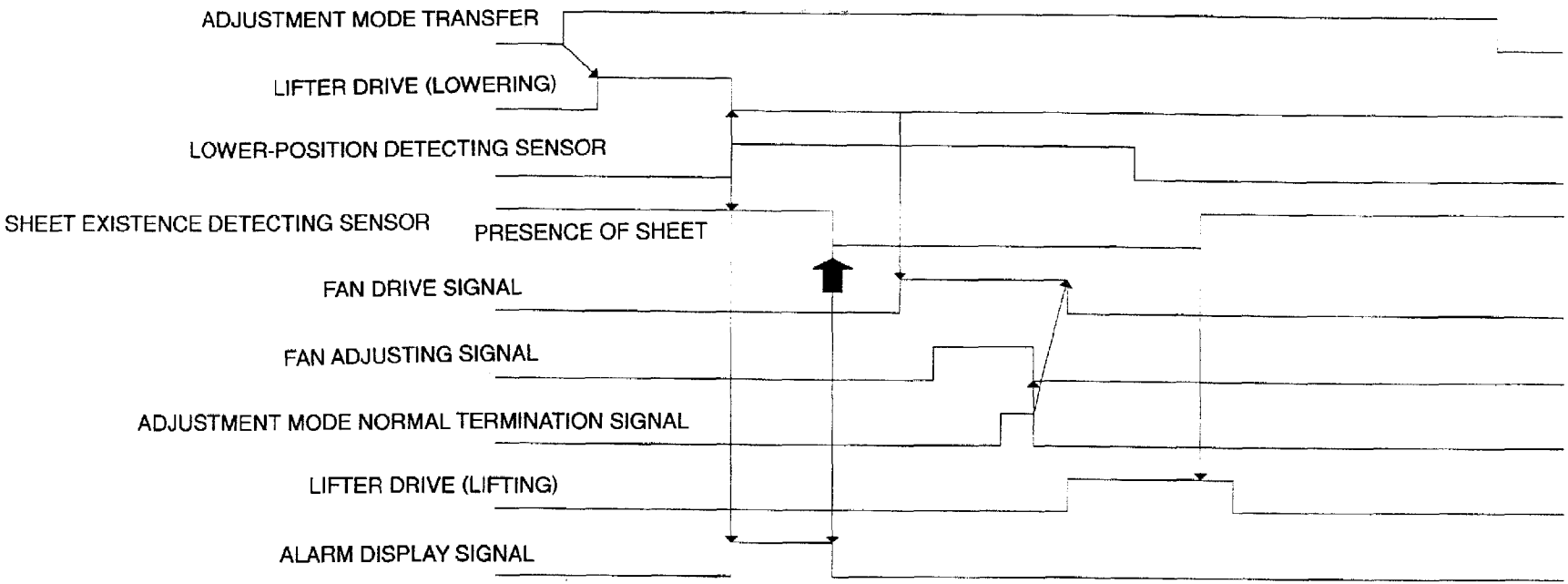
FIG. 23 illustrates a timing chart from start of the adjustment of the fan rotating speed to the normal end after a sheet is removed.

The state in which the fan rotating speed is adjusted after the several sheets in the upper portion of the sheets loaded on the tray 302 are removed will be described below with reference to a timing chart of FIG. 23. In order to remove the sheets loaded on the tray 302, it is necessary that the sheet accommodation portion be drawn from the apparatus body, and it is necessary that the sheet accommodation portion be accommodated in the apparatus body after the sheets are removed. However, the operations are neglected here. After the several sheets in the upper portion of the sheets loaded on the tray 302 are removed, the loosening fan F151 is driven when the sheet existence detecting sensor 606 detects the absence of the sheet. After a predetermined time elapses since the operation of the loosening fan F151 is started, the rotating speed adjustment of the loosening fan F151 is started. In the case where the rotating speed of the loosening fan F151 falls within the predetermined rotating speed range within the predetermined time, the rotating speed adjustment of the loosening fan F151 is ended, and the operation of the loosening fan F151 is stopped. Then, the tray 302 is lifted, and the lifter motor M5 is stopped to stop the tray 302 when the sheet existence detecting sensor 606 detects the presence of the sheet, which transfers to the standby state. Therefore, the feeding can be started in response to the feeding start signal.

Figure 24:
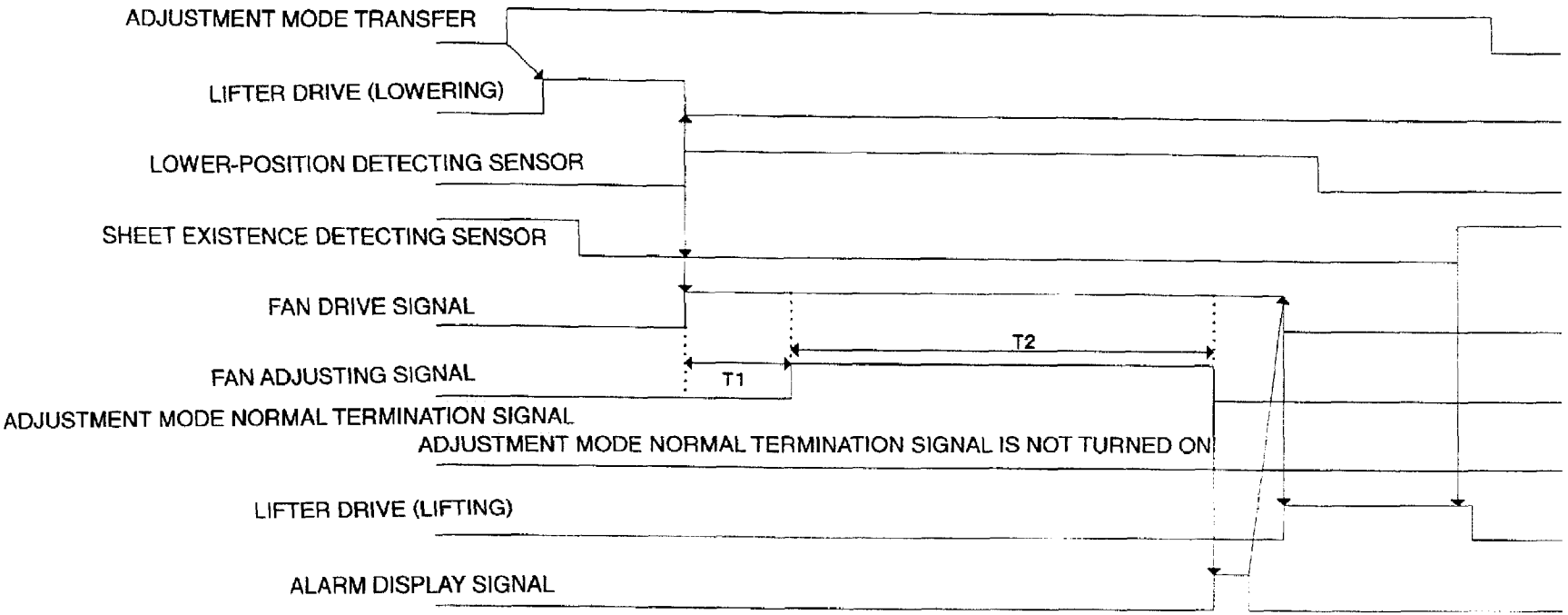
FIG. 24 illustrates a timing chart explaining control after the adjustment of the fan rotating speed fails.

The case in which the adjustment of the fan rotating speed fails will be described with reference to FIG. 24. When the adjustment signal becomes H (active) to enter the rotating-speed adjustment mode of the loosening fan F151, the lifter motor M5 is controlled to start the lowering operation of the tray 302. When the tray 302 reaches the lower-position detecting sensor 605, the lifter motor M5 is stopped. When the lifter motor M5 is stopped and the sheet existence detecting sensor 606 detects the absence of the sheet, the loosening fan F151 is driven. The rotating speed adjustment of the loosening fan F151 is started after the predetermined time T1 elapses since the operation of the loosening fan F151 is started. The rotating speed adjustment of the loosening fan F151 is performed for the predetermined time T2. In the case where the rotating speed of the loosening fan F151 does not fall within the predetermined range of the target value within the predetermined time T2, the rotating speed adjustment of the loosening fan F151 is ended, and the warning indicating that the rotating speed adjustment fails is displayed as shown in FIG. 19. Then, the operation of the loosening fan F151 is stopped.

After the raising operation of the tray 302 is performed by the lifter motor M5, the sheet existence detecting sensor 606 outputs the stop signal. Alternatively, the floatation lower-limit sensor 607 or the floatation upper-limit sensor 608 may be used to output the stop signal.

(Flowchart of Adjustment Mode)

Figure 17:
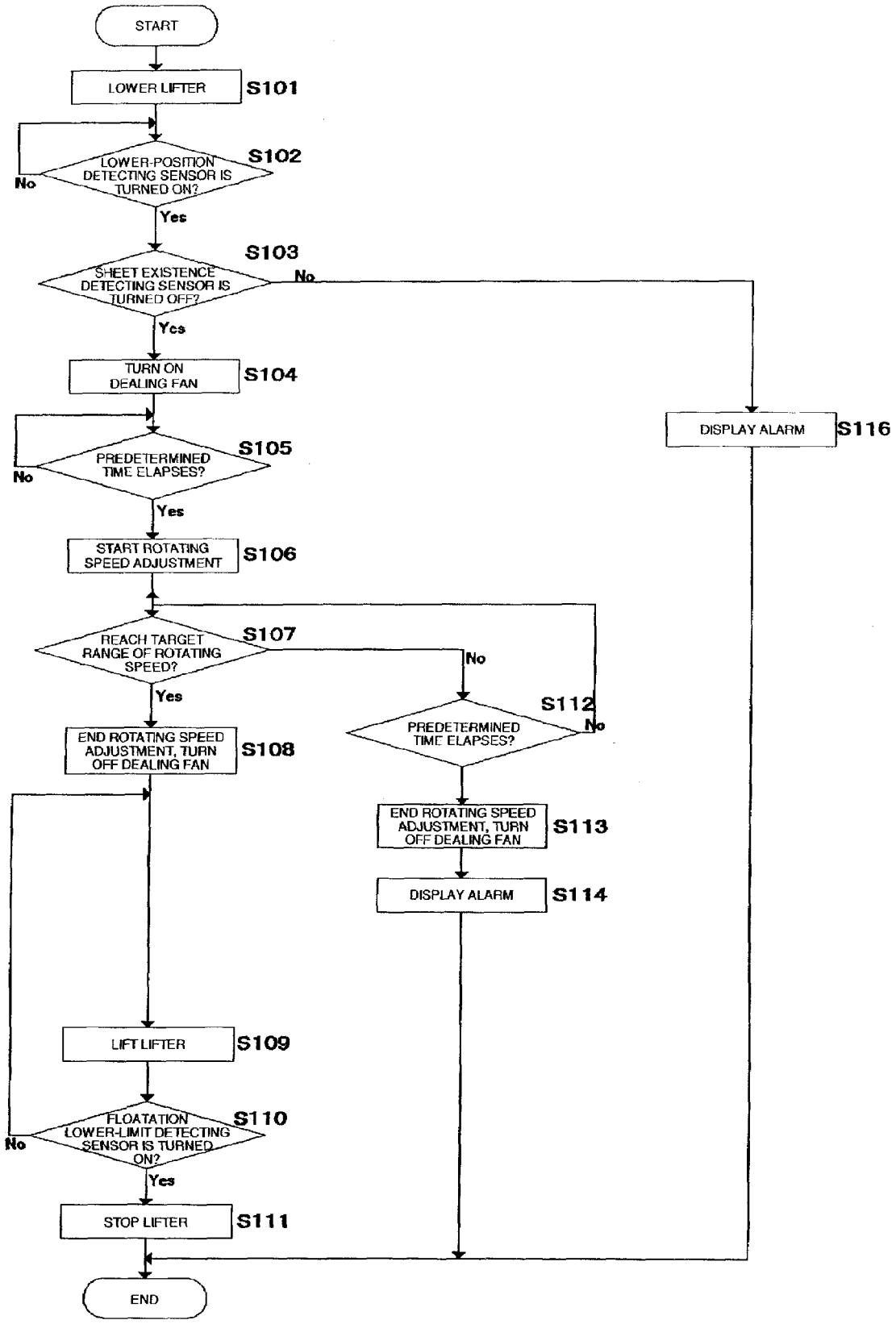
FIG. 17 is a flowchart illustrating adjustment of fan air quantity according to the embodiment.

The operation concerning the adjustment mode will be described with reference to a flowchart of FIG. 17.

The operations of the sheet feeding apparatus 3000 and loosening fan F151 after the loosening fan F151 is transferred to the adjustment mode after the power is turned on, after predetermined number of sheets are conveyed by the sheet feeding apparatus 3000, or after a predetermined time elapses will mainly be described.

In the rotating-speed adjustment mode of the loosening fan F151, the lifter motor M5 controlling the tray 302 starts the lowering operation of the tray 302 (S101). When the tray 302 reaches the lower-position detecting sensor 605 (S102), the lifter motor M5 is stopped. The sheet existence detecting sensor 606 detects the presence or absence of the sheet (S103). When the sheet existence detecting sensor 606 detects the presence of the sheet, the warning is displayed on the operation screen as shown in FIG. 18 (S116). The sheet accommodation portion is opened to remove the several sheets loaded on the tray 302, and the sheet accommodation portion is closed, which starts a series of the processes from the step S101.

On the other hand, when the sheet existence detecting sensor 606 detects the absence of the sheet, the loosening fan F151 is driven. In the case where the plural loosening fans are continuously connected, the plural loosening fans are controlled so as to be simultaneously operated (S104). After the predetermined time elapses since the operation of the loosening fan F151 is started (S105), the rotating speed adjustment of the loosening fan F151 is started (S106). After the rotating speed adjustment of the loosening fan F151 is started, it is determined whether or not the rotating speed of the loosening fan F151 falls within the predetermined range of the target value within the predetermined time (S107). When the rotating speed of the loosening fan F151 does not fall within the predetermined range of the target value within the predetermined time (S112), the rotating speed adjustment of the loosening fan F151 is ended, and the operation of the loosening fan F151 is stopped (S113). Then, as shown in FIG. 19, the warning indicating that the rotating speed adjustment of the loosening fan F151 fails is displayed (S114). In FIG. 19, the rotating speed of the fan is adjusted again. Alternatively, an error message may be displayed. The warning indicating that the rotating speed adjustment fails may be displayed before operation stop timing of the loosening fan F151.

On the other hand, when the rotating speed of the loosening fan F151 falls within the predetermined range of the target value within the predetermined time (S107), the rotating speed adjustment of the loosening fan F151 is ended, and the operation of the loosening fan F151 is stopped (S108). Then, the tray is lifted (S109). When the sheet existence detecting sensor 606 detects the presence of the sheet (S110), the lifter motor M5 is stopped to stop the tray 302 (S111), which transfers to the standby state. Therefore, the feeding can be started in response to the feeding start signal.

Thus, the rotating speed can be adjusted such that the wind pressure necessary for the fan is obtained by including the rotating speed adjustment mode of the loosening fan. Therefore, the rotating speed can be set such that the loosening fan becomes the optimum air quantity (wind pressure) irrespective of the fluctuation of the fan, the aged deterioration of the fan characteristics, and the voltage drop caused by the bundle conductors. The loosening fan can be stabilized at the optimum rotating speed. In the configuration in which plural fans are continuously connected, the range of the target value is set to adjust the rotating speed in each fan based on the relationship between the fan rotating speed and the fan wind pressure, which allows the optimum wind pressure to be set in each fan.

In the above embodiment, the tray 302 is lowered to the lower position in the rotating speed adjustment mode, and the rotating speed adjustment of the loosening fan F151 is started when the sheet existence detecting sensor 606 detects the absence of the sheet. Alternatively, following may be applicable. That is, the tray 302 is lowered in the rotating speed adjustment mode, the rotating speed adjustment may be started when the sheet loading position detecting sensor 609 detects the uppermost surface of the sheet stack S supported by the tray 302. In this case, because the uppermost surface of the sheet stack S is already located below the detection position of the sheet existence detecting sensor 606, it is not necessary that the rotating speed be adjusted based on the detection of the sheet existence detecting sensor 606. That is, when the sheet loading position detecting sensor 609 detects the position of the uppermost surface of the sheet stack S supported by the tray 302, the sheet stack S is not located in front of the air outlet of the loosening nozzle 151 of the loosening fan F151. In this case, when the lower-position detecting sensor 605 detects the tray 302 before the sheet loading position detecting sensor 609 detects the uppermost surface of the sheet stack S, the control is performed based on the detection of the sheet existence detecting sensor 606 in the above embodiment.

The rotating speed adjustment of the loosening fan F151 may be started as follows. The lifting and lowering of the tray 203 are counted with a counter to detect the position in the height direction of the tray 203. That is, the position in the height direction of the tray 203 can be detected in the form of the number of counts using the encoder provided in the lifter motor M5 or a stepping motor which is of the lifter motor. The number of counts is set to zero at the lower position, and the number of counts is incremented as the tray 203 is lifted. In the rotating speed adjustment mode, the tray 302 is lowered at the predetermined number of counts. At this point, the number of counts is a value when the sheet stack S loaded on the tray 302 is eliminated in front of the air outlet of the loosening nozzle 151 of the loosening fan F151, the number of counts can previously be set. In this case, when the lower-position detecting sensor 605 detects the tray 302 before the number of counts reaches the predetermined value, the control is performed based on the detection of the sheet existence detecting sensor 606 of the above embodiment.

In the above embodiment, the sheet feeding apparatus or the sheet insertion apparatus includes two sheet feeding portions having the air separating and feeding mechanisms. The number of sheet feeding portions having the air separating and feeding mechanisms is not limited to two, but any number of sheet feeding portions may be used as needed.

In the embodiment, the sheet feeding apparatus provided on the upstream side in the sheet conveyance direction of the image forming apparatus body and the sheet insertion apparatus provided on the downstream side in the sheet conveyance direction are shown as an example of the sheet feeding apparatus having the sheet loosening fan (air separating and feeding mechanism). However, the invention is not limited to the above embodiment. For example, the invention can be applied to the sheet feeding apparatus which is integral with the image forming apparatus body.

In the embodiment, the sheet feeding apparatus separates and feeds the sheet of the recording target one by one. However, the invention is not limited to the above embodiment, but the invention can effectively be applied to the sheet feeding apparatus which separates and feeds the sheet of the reading target one by one.

This application claims the benefit of Japanese Patent Applications No. 2006-101824, filed Apr. 3, 2006 and 2007-076661 filed Mar. 23, 2007 which are hereby incorporated by reference herein in their entirety.

What is claimed is:

1. An image forming apparatus that has a sheet feeding apparatus which separates and feeds a sheet one by one, the image forming apparatus comprising:

a tray which supports a plurality of sheets;

an air blowing portion which loosens the sheet by blowing air to an end portion of the sheets supported by the tray, and the air blowing portion has a sheet loosening fan;

a rotating-speed detecting unit which detects a rotating speed of the sheet loosening fan; and a control unit which controls a lifting and lowering operation of the tray and an operation of the sheet loosening fan;

wherein the control unit adjusts the rotating speed of the sheet loosening fan based on the detection of the rotating-speed detecting unit so as to fall within a predetermined range of a target value while the sheet supported by the tray is not located in front of an outlet of the air blowing portion.

2. The image forming apparatus according to claim 1, further comprising:

a lower position detecting unit which detects that the tray is located at a lower position which is of the lowest position within a lifting and lowering range of the tray; and a sheet existence detection unit which detects presence or absence of the sheet supported by the tray;

wherein a position where the sheet existence detection unit detects the absence of the sheet on the tray is set such that the sheet supported by the tray is below the position where the air is blown from the sheet loosening fan, and the control unit lowers the tray until the lower position detecting unit detects the tray, and the control unit starts an adjusting operation of the rotating speed of the sheet loosening fan while the sheet existence detection unit detects the absence of the sheet while the tray is located at the lower position.

3. The image forming apparatus according to claim 1, further comprising:

a sheet loading position detecting unit which detects an uppermost surface of the sheet supported by the tray in the lifting and lowering range of the tray, the sheets is loaded on the tray which is stopped based on the detection of the sheet loading position detecting unit, wherein, after the control unit lowers the tray until the sheet loading position detecting unit detects the uppermost surface of the sheet, the control unit starts the adjusting operation of the rotating speed of the sheet loosening fan.

4. The image forming apparatus according to claim 3, further comprising:

a lower position detecting unit which detects that the tray is located at a lower position which is of the lowest position within a lifting and lowering range of the tray; and a sheet existence detection unit which detects presence or absence of the sheet supported by the tray;

wherein a position where the sheet existence detection unit detects the absence of the sheet on the tray is set such that the sheet supported by the tray is below the position where the air is blown from the sheet loosening fan, and the control unit lowers the tray, and the control unit starts an adjusting operation of the rotating speed of the sheet loosening fan when the lower position detecting unit detects the tray before the sheet loading position detecting sensor detects the uppermost surface of the sheet and, while the sheet existence detection unit detects the absence of the sheet.

5. The image forming apparatus according to claim 2, wherein the control unit does not perform the adjusting operation of the rotating speed of the sheet loosening fan but displays a warning on an operation screen, when the lower position detecting unit detects the tray and, when the sheet existence detection unit detects the presence of the sheet.

6. The image forming apparatus according to claim 3, further comprising:

a sheet existence detection unit which detects presence or absence of the sheet supported by the tray, wherein in case that the sheet existence detection unit detects the absence of the sheet on the tray, the tray moves downwards until the sheet loading position detecting unit detects the tray, and then a process to adjust the rotating speed of the sheet loosing fan begins in a status that the tray stays at a lowered position.

7. The image forming apparatus according to claim 1, wherein the control unit controls to adjust the rotating speed after a predetermined time elapses since an operation of the sheet loosening fan is started.

8. The image forming apparatus according to claim 1, wherein the control unit outputs a signal indicating that the sheet loosening fan is normally ended, when the rotating speed of the sheet loosening fan falls within the range of the target value after the control unit starts the adjusting operation of the rotating speed of the sheet loosening fan.

9. The image forming apparatus according to claim 1, wherein the control unit performs control to adjust the rotating speed of the sheet loosening fan for a predetermined time.

10. The image forming apparatus according to claim 1, wherein the control unit stops the operation of the sheet loosening fan to display the warning on the operation screen, when the rotating speed of the sheet loosening fan does not fall within the range of the target value within a predetermined time since the adjustment of the rotating speed is started.

11. The image forming apparatus according to claim 1, wherein the control unit stops the operation of the sheet loosening fan and lifts the tray until the sheet existence detection unit detects the presence of the sheet, when the rotating speed of the sheet loosening fan falls within the range of the target value within a predetermined time since the adjustment of the rotating speed is started.

12. The image forming apparatus according to claim 1, wherein the control unit adjusts the rotating speed of the sheet loosening fan, after the power is turned on, or after any number of sheets are conveyed.

13. The image forming apparatus according to claim 1, further comprising:

a lower position detecting unit which detects that the tray is located at a lower position which is of the lowest position within a lifting and lowering range of the tray; and a sheet existence detection unit which detects a presence or an absence of the sheet supported by the tray;

wherein a position where the sheet existence detection unit detects the absence of the sheet on the tray is set such that the sheet supported by the tray is below the position where the air is blown from the sheet loosening fan, and the control unit starts an adjusting operation of the rotating speed of the sheet loosening fan based on a detection of the lower position detecting unit and a detection of the sheet existence detection.

14. An image forming apparatus that has a sheet feeding apparatus which separates and feeds a sheet one by one, the image forming apparatus comprising:

a tray which supports a plurality of sheets;

an air blowing portion which blows air to an edge of the sheets to loosen a sheet on the tray; and a control unit which controls a lifting and lowering operation of the tray and an operation of the air blowing portion, wherein the control unit adjusts the air blowing portion so that an amount of blowing air from the air blowing portion is within a range of a predetermined value after the control unit lowers the tray so as that the sheets on the tray and the tray are removed from in front of an air outlet of the air blowing portion.

15. The image forming apparatus according to claim 14, further comprising:

a lower position detecting unit which detects that the tray is located at a lower position which is of the lowest position within a lifting and lowering range of the tray; and a sheet existence detection unit which detects presence or absence of the sheet supported by the tray;

wherein a position where the sheet existence detection unit detects the absence of the sheet on the tray is set such that the sheet on the tray is below the position where the air is blown by the air blowing portion, and the control unit starts an adjusting operation of the air blowing portion based on detections of the lower position detecting unit and on the detections of the sheet existence detection unit.

16. The image forming apparatus according to claim 15, wherein the control unit does not perform the adjusting operation of the air blowing portion but displays a warning on an operation screen, while the lower position detecting unit detects the tray and, while the sheet existence detection unit detects the presence of the sheet.

17. The image forming apparatus according to claim 14, further comprising:

a sheet loading position detecting unit which detects an uppermost surface of the sheet supported by the tray in the lifting and lowering range of the tray, the sheets is loaded on the tray which is stopped based on the detection of the sheet loading position detecting unit, wherein, the control unit starts the adjusting operation of the air blowing portion based on the detection of the sheet loading position detecting unit.

18. The image forming apparatus according to claim 14, wherein the control unit adjusts the air blowing portion, after the power is turned on.

* * * * *